US005702801A

United States Patent [19]

Chien

[11] Patent Number: 5,702,801

[45] Date of Patent: Dec. 30, 1997

[54] METHOD FOR PRODUCING A VARIABLE DENSITY, CORRUGATED RESIN-BONDED OR THERMO-BONDED FIBERFILL AND THE STRUCTURE PRODUCED THEREBY

[75] Inventor: Jung-Fu Chien, Montebello, Calif.

[73] Assignee: Shinih Enterprise Co., Ltd., Taipei, Taiwan

[21] Appl. No.: 548,259

[22] Filed: Oct. 25, 1995

Related U.S. Application Data

[63] Continuation-in-part of Ser. No. 293,239, Aug. 19, 1994, Pat. No. 5,558,924, which is a continuation-in-part of Ser. No. 246,953, May 20, 1994, abandoned, which is a continuation-in-part of Ser. No. 246,880, May 20, 1994, abandoned, which is a continuation-in-part of Ser. No. 841,805, Feb. 26, 1992, abandoned.

[51] Int. Cl.[6] ..... B32B 3/28

[52] U.S. Cl. ..... 428/181; 428/175; 428/176; 428/182; 428/192; 428/193; 428/218; 428/224; 428/288; 428/289; 156/181; 156/204; 156/205

[58] Field of Search ..... 428/212, 220, 428182, 105, 107, 114, 121, 130, 175, 176, 181, 192, 193, 218, 224, 288, 289, 397; 156/205, 204, 181; 264/257

[56] References Cited

U.S. PATENT DOCUMENTS

| | | | |
|---|---|---|---|
| 1,988,843 | 1/1935 | Heldenbrand | 428/178 |
| 2,029,370 | 2/1936 | Heldenbrand | 428/178 |
| 2,409,951 | 10/1946 | Nootens | 428/182 |
| 2,428,709 | 10/1947 | Hlavaty | 19/163 |
| 2,684,107 | 7/1954 | Schultz | 154/27 |
| 2,689,811 | 9/1954 | Frederick et al. | 154/55 |
| 3,227,592 | 1/1966 | Coates et al. | 156/93 |
| 3,879,820 | 4/1975 | Grieves et al. | 28/110 |
| 4,111,733 | 9/1978 | Periers | 156/204 |
| 4,335,176 | 6/1982 | Baumann | 442/388 |
| 4,567,078 | 1/1986 | Blackmore et al. | 428/119 |
| 4,576,853 | 3/1986 | Vaughn et al. | 428/181 |
| 4,749,423 | 6/1988 | Vaalburg et al. | 156/181 |
| 4,818,599 | 4/1989 | Marcus | 442/333 |
| 4,837,067 | 6/1989 | Carey, Jr. et al. | 428/108 |
| 4,957,805 | 9/1990 | Biggs et al. | 428/223 |
| 5,057,168 | 10/1991 | Muncrief | 156/62.6 |

FOREIGN PATENT DOCUMENTS

| | | |
|---|---|---|
| 0179451 | 7/1987 | European Pat. Off. . |
| 0360627 | 1/1990 | European Pat. Off. . |
| 0558205 | 9/1993 | European Pat. Off. . |
| 47-46030 | 11/1972 | Japan . |
| 146063 | 11/1990 | Taiwan . |
| 172294 | 11/1991 | Taiwan . |
| 1286416 | 1/1987 | U.S.S.R. . |
| 2077786 | 12/1981 | United Kingdom . |
| 2219737 | 12/1989 | United Kingdom . |

*Primary Examiner*—Donald Loney
*Attorney, Agent, or Firm*—Leydig, Voit & Mayer, Ltd.

[57] ABSTRACT

A corrugated fiberfill structure is provided including at least one fibrous web folded to form a plurality of pleats having alternating crests and bases, each of the pleats having a pair of legs in which each of the legs has a first leg surface and a second leg surface, the first leg surface of one leg being in intimate contact with the first leg surface of an adjoining leg of the pleat and the second leg surface of the one leg being in intimate contact with the second leg surface of one adjoining leg of an adjacent pleat over a portion of each leg. At least some crests define a first structural surface and at least some bases define a second structural surface; with the distance between the first and second structural surfaces defining the thickness of the structure. The pleats of the structure are so arranged across the thickness that the density of the structure varies between the first and second structural surfaces. A method for forming a corrugated bonded fiberfill structure having pleats, a first surface defined by crests of at least some of the pleats and a second surface defined by bases of at least some of the pleats is also provided which includes lapping at least one fibrous web formed from first fibers and second fibers in alternating directions to form alternating laps; folding the fibrous web to form a corrugated fibrous web having variations in density between the first and second surfaces; and bonding the pleats of the corrugated fibrous web.

22 Claims, 27 Drawing Sheets

FIG.9B
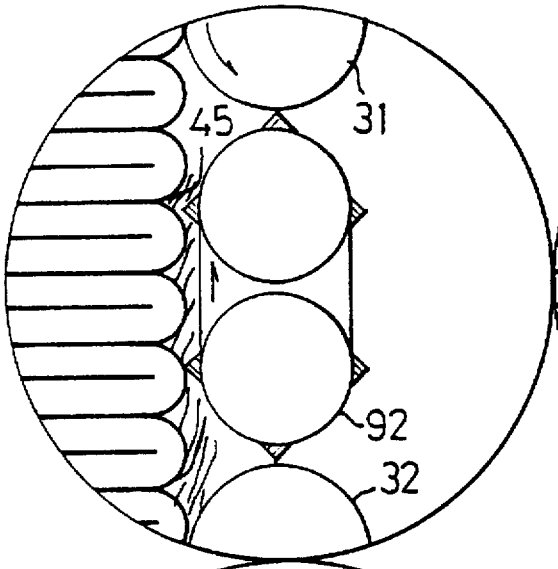
FIG.9D
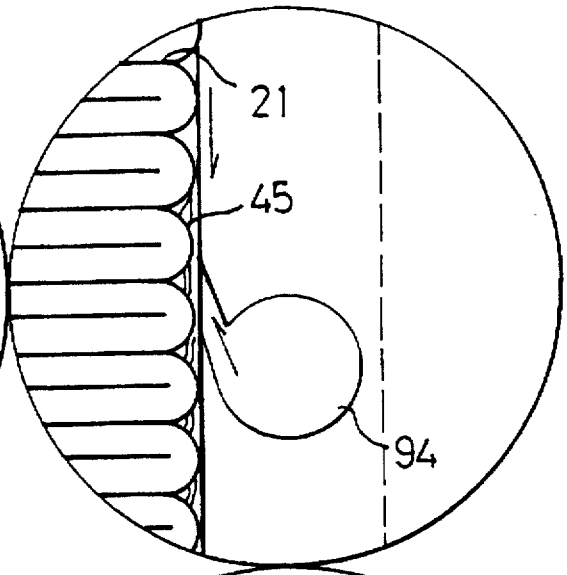
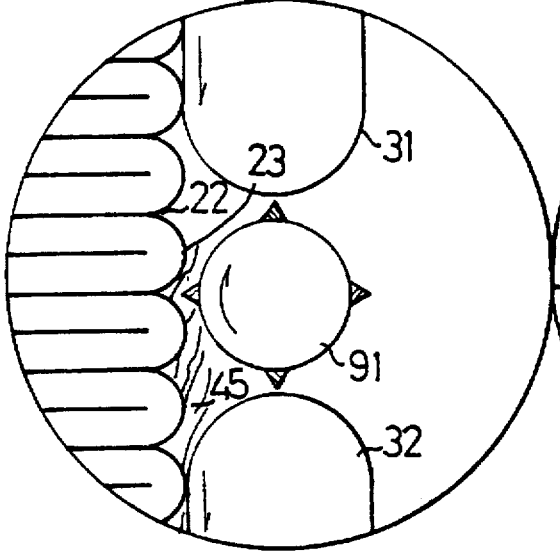
FIG.9A
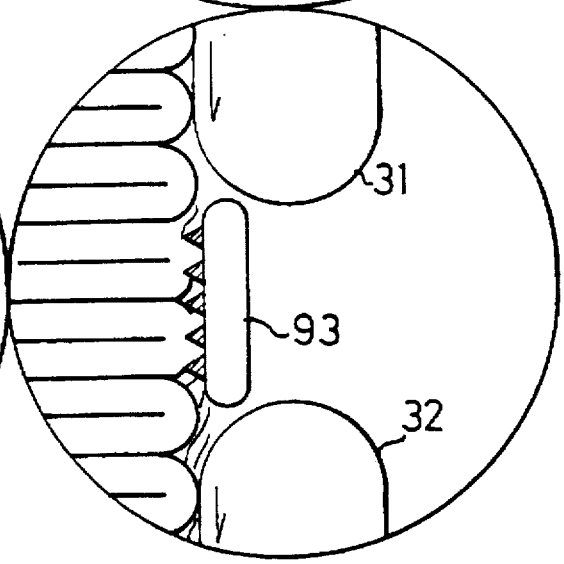
FIG.9C

METHOD FOR PRODUCING A VARIABLE DENSITY, CORRUGATED RESIN-BONDED OR THERMO-BONDED FIBERFILL AND THE STRUCTURE PRODUCED THEREBY

This application is a continuation-in-part of U.S. patent application Ser. No. 08/293,239, filed Aug. 19, 1994 now U.S. Pat. No. 5,558,924 which is a continuation-in-part of U.S. patent application Ser. No. 08/246,953, filed May 20, 1994, now abandoned which is a continuation-in-part of U.S. patent application Ser. No. 08/246,880, filed May 20, 1994 now abandoned which is a continuation-in-part of U.S. patent application Ser. No. 07/841,805, filed Feb. 26, 1992, now abandoned, all of which are incorporated herein by reference.

FIELD OF THE INVENTION

The present invention relates to a corrugated fiberfill structure and to a method for forming same. More particularly, the present invention relates to a varying density, corrugated, resin-bonded or thermo-bonded fiberfill structure and to a method for forming same.

BACKGROUND OF THE INVENTION

According to a known method, shown in FIG. 1, after opening a bale and carding fibers to form a web A, the web A is shaped into zig-zag lamination A' to create strength in both longitudinal and transverse directions. This is accomplished by sequentially conveying belts B, C, and D, which transversely convey the web A. Belt E conveys longitudinally, whereas conveying belts C and D independently reciprocate transversely. After the zig-zag lamination A' is shaped by cross-lapping, resin is sprayed on the lamination A', thereby penetrating and bonding the lamination A'. However, the prior process possesses the following drawbacks:

1. The thickness of the web A' must differ with various applications. The thickness of the lamination A' depends on the number of single webs A present, i.e., the manufacturing conditions must be controlled under a higher conveying speed of conveying belts B, C, and D; a higher transverse moving speed of conveying belts of C and D; and/or a lower speed of conveying belt E. Regarding a specification of 500 $g/m^2$ of the bonded fiberfill, the resulting cross angle of lamination A' is small or even nearly zero, thereby maintaining transverse strength but, at the same time, decreasing longitudinal strength. Accordingly, the performance of the final product is inferior with regard to the longitudinal strength.

2. Taking a carding web of 20 $g/m^2$, for example, a final product having a thickness of 500 $g/m^2$ necessitates 25 layers of card web, thereby resulting in low productivity, poor resin-penetration, and making it difficult for the zig-zag lamination A' to bond together.

3. Conventional resin-bonded fiberfill only provides strength with respect to the transverse and longitudinal directions but lacks three-dimensional strength. Therefore, the final products possess poor anti-compression properties, etc.

It is the purpose of the present invention, therefore, to mitigate and/or obviate the above-mentioned drawbacks in the manner set forth below.

SUMMARY OF THE INVENTION

Accordingly, it is an object of this invention to provide a method for corrugating bonded fiberfill which enhances three-dimensional strength and resilience of the final product.

Another object of this invention is to provide a method for corrugating bonded fiberfill which allows excellent penetration of resin and hot air by means of resin bonding or thermo-bonding, thereby resulting in products having increased strength.

Another object of this invention is to provide an improved structure of resin-bonded or thermo-bonded fiberfill which possesses enhanced properties of anti-compression and air permeability, for use in products such as quilts, pillows, cushioned seats, cushions, mattresses, sleeping bags, ski jackets, etc. and as filtering material.

A further object of this invention is to provide an improved structure of resin-bonded or thermo-bonded fiberfill which supplies an alternative thickness by regulating the corrugated fiber web, thereby maintaining anti-compression and air permeability.

An additional object of the present invention is to produce a fiberfill product having a smooth and even surface.

Yet another object of the present invention is to provide an improved fiberfill structure in which strength is improved in the machine direction on the surface of the structure while retaining the vertical strength in the remaining corrugations.

Still another object of the present invention is to produce a corrugated fiberfill structure which may be of low density, good stuffability, high bulk recovery when unloaded, low bulk under load, extremely soft feel and having a drape suitable for products such as comforters, sleeping bags and apparel.

Other objects of the present invention include a corrugated fiberfill structure having a soft surface and a firm interior and a method of forming such structure.

Yet other objects include a fiberfill structure varying in density between the surfaces of the structure and to a method of forming such structure.

The invention is directed to a corrugated fiberfill structure including at least one fibrous web folded to form a plurality of pleats having alternating crests and bases, each of the pleats having a pair of legs, and each of the legs having a first leg surface and a second leg surface. The first leg surface of one leg is disposed in intimate contact with at least a portion of the first leg surface of an adjoining leg of the pleat, and at least a portion of the second leg surface of the leg is in intimate contact with at least a portion of the second leg surface of one adjoining leg of an adjacent pleat over a portion of each leg. At least some of the crests of said plurality of pleats define a first structural surface and at least some of said bases of said plurality of pleats define a second structural surface. The distance between the first and second structural surfaces defines the thickness of the structure and the density of the structure varies across the thickness of the structure. The fiberfill structure of the present invention may be formed from one fibrous web or several fibrous webs. When more than one fibrous web is employed, the pleats of one fibrous web engage the pleats of the other fibrous web(s). In another embodiment of the varying density fiberfill structure, the crests and bases of at least some of the pleats of the corrugated fibrous web are brushed so that fibers from each of the brushed crests and bases extend to nearby crests and bases, respectively.

In another aspect of the present invention, the pleats are arranged to have an arcuate configuration. In still another aspect of the present invention, the crest portions and base portions of at least some of the pleats are folded so as to be at least partially laid-over a corresponding crest or base portion, respectively, which are in contact therewith. This provides a more even or smoother surface to the structure.

The present invention is also directed to a method for forming a corrugated fiberfill structure having a first surface defined by crests of at least some of the pleats and a second surface defined by bases of at least some of the pleats which includes:

(a) lapping a fibrous web in alternating directions to form alternating laps; and (b) folding the fibrous web in such a manner to form a corrugated fibrous web having variations in density between the first and second surfaces. If a thermo-bonded structure is being prepared, then the fibrous web(s) employed may be formed from first fibers and second fibers, the latter having a lower melting point than the former. After forming the green corrugated fibrous web(s), the structure may be heated to bond the corrugations and the first fibers together. If a resin-bonded structure is desired, after the green corrugated fibrous web is formed, a suitable resin may be applied to the corrugated web and heated.

If a corrugated web is desired in which the crests and bases or troughs of at least some of the pleats are folded over to overlap corresponding crests and bases of pleats in contact therewith, once the corrugated structure is initially formed, the corrugated web may be passed through a forming chamber or conveying passage in which the opposing sides are spaced from one another by a distance shorter than the thickness of the corrugated web, thereby causing at least some of the crests and bases of the pleats to be folded over crests and pleats in contact therewith.

Further objects and advantages of the present invention will become apparent with the description that follows.

BRIEF DESCRIPTION OF THE DRAWINGS

FIGS. 9A, 9B, 9C and 9D show various embodiments of the brushing device illustrated in FIG. 8;

Figure 27:
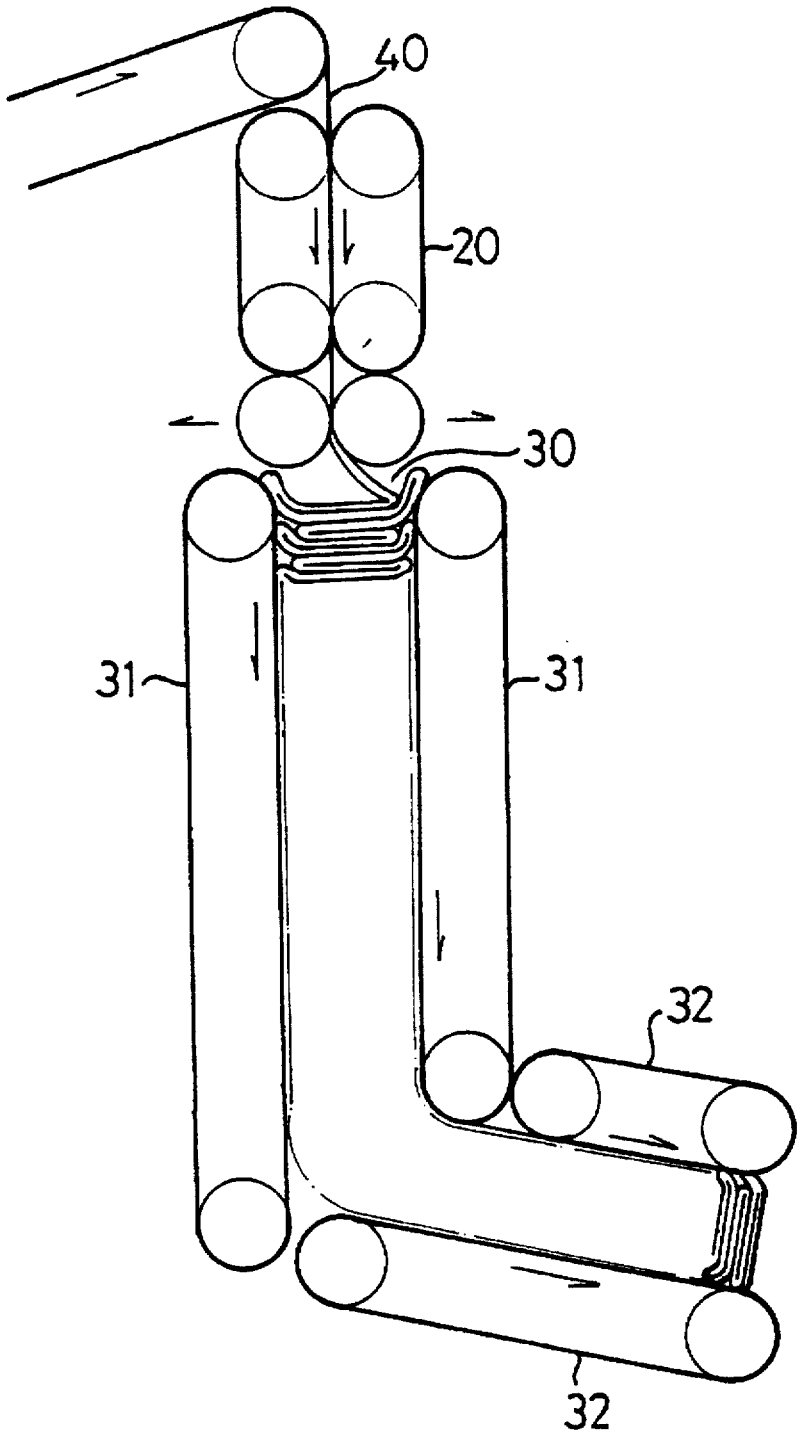
Figure 28:
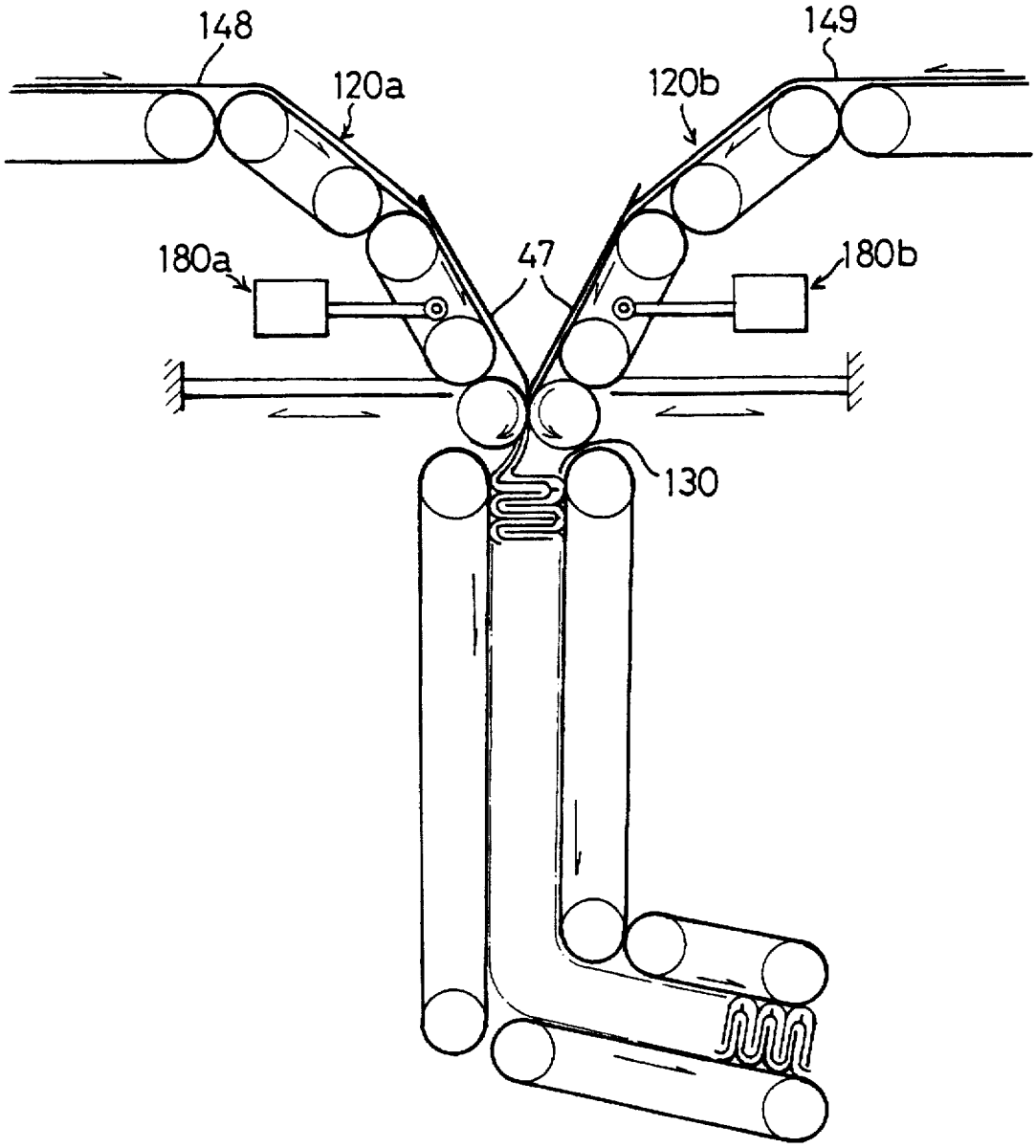
Figure 29:
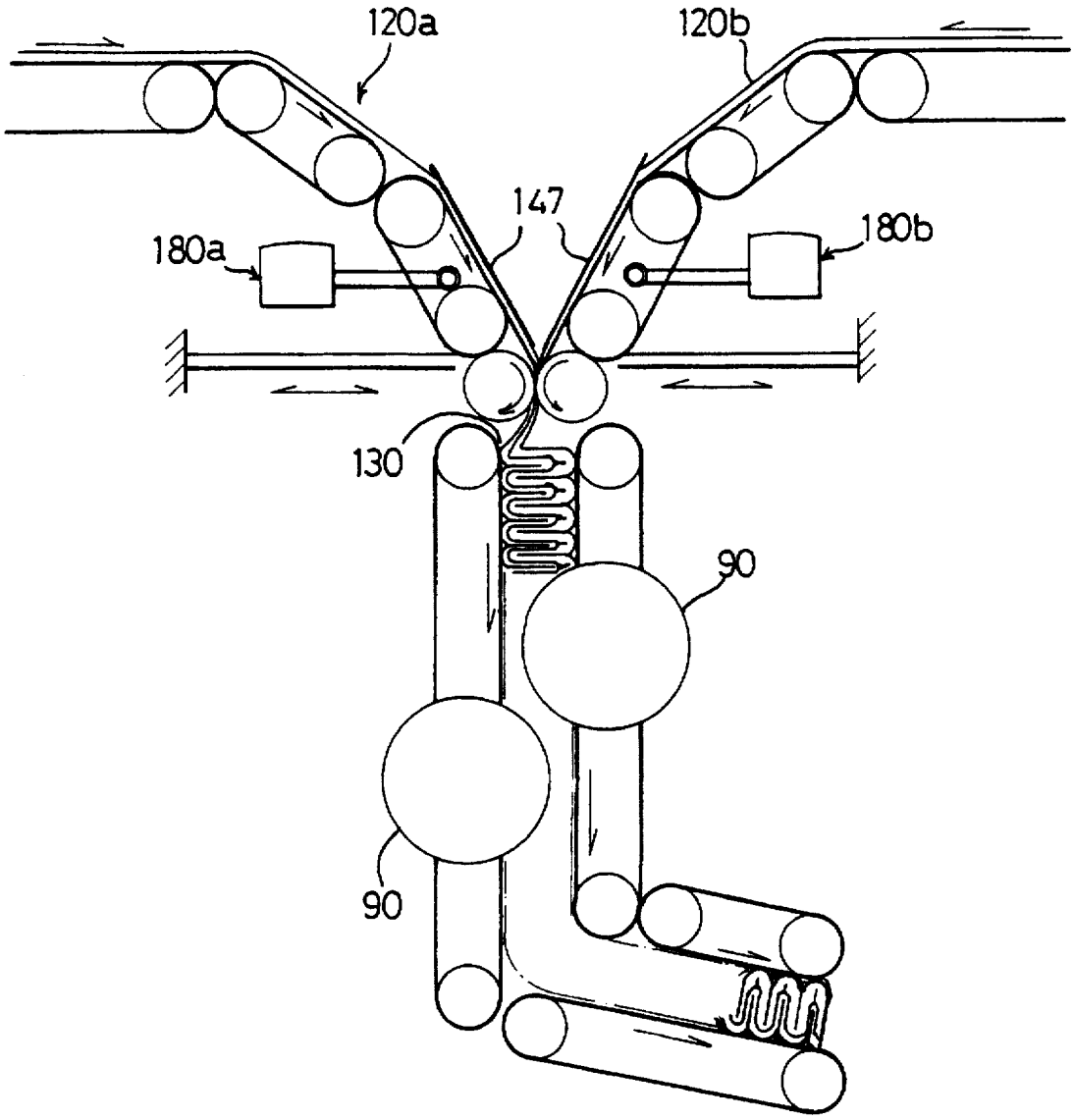
Figure 30:
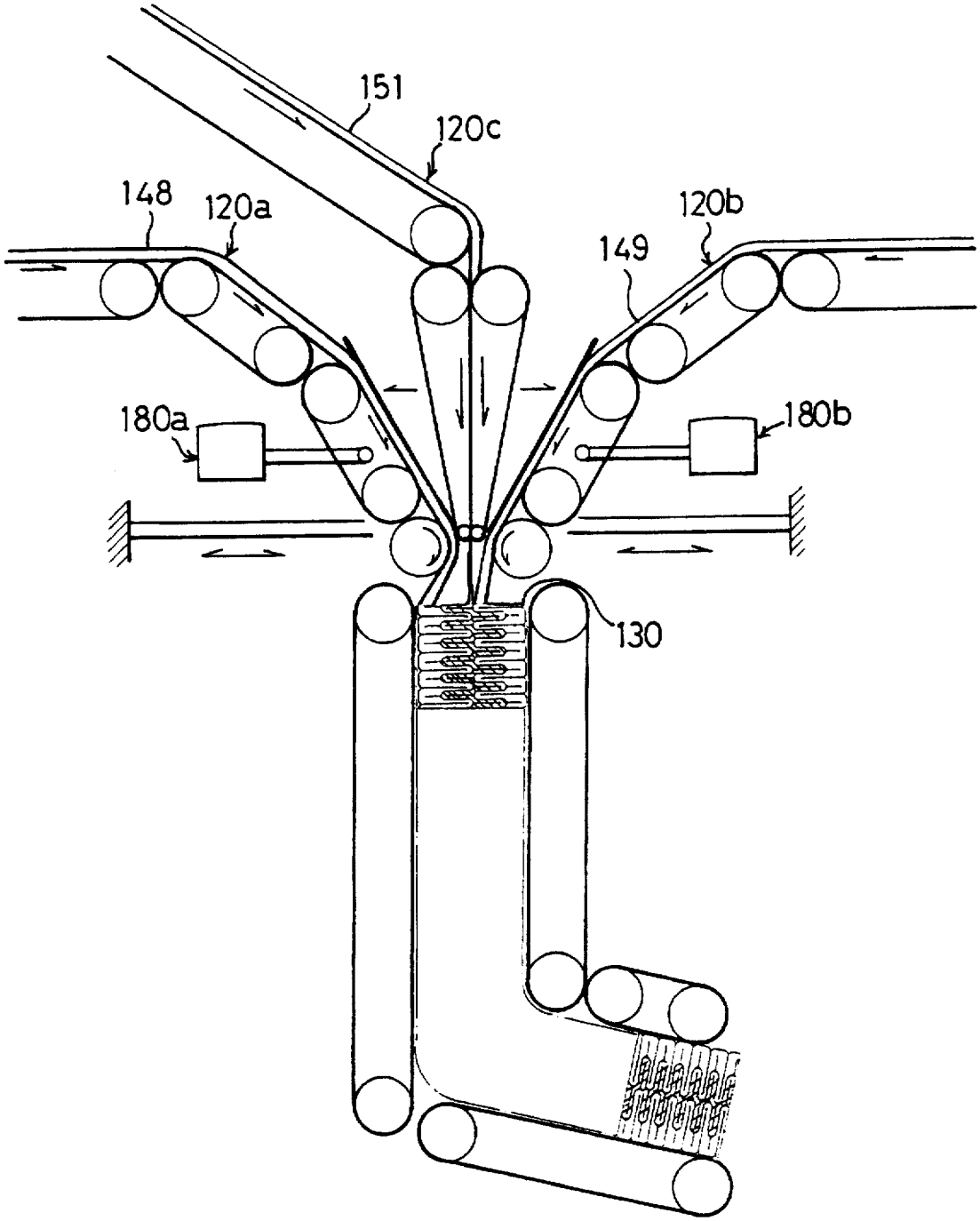
Figure 31:
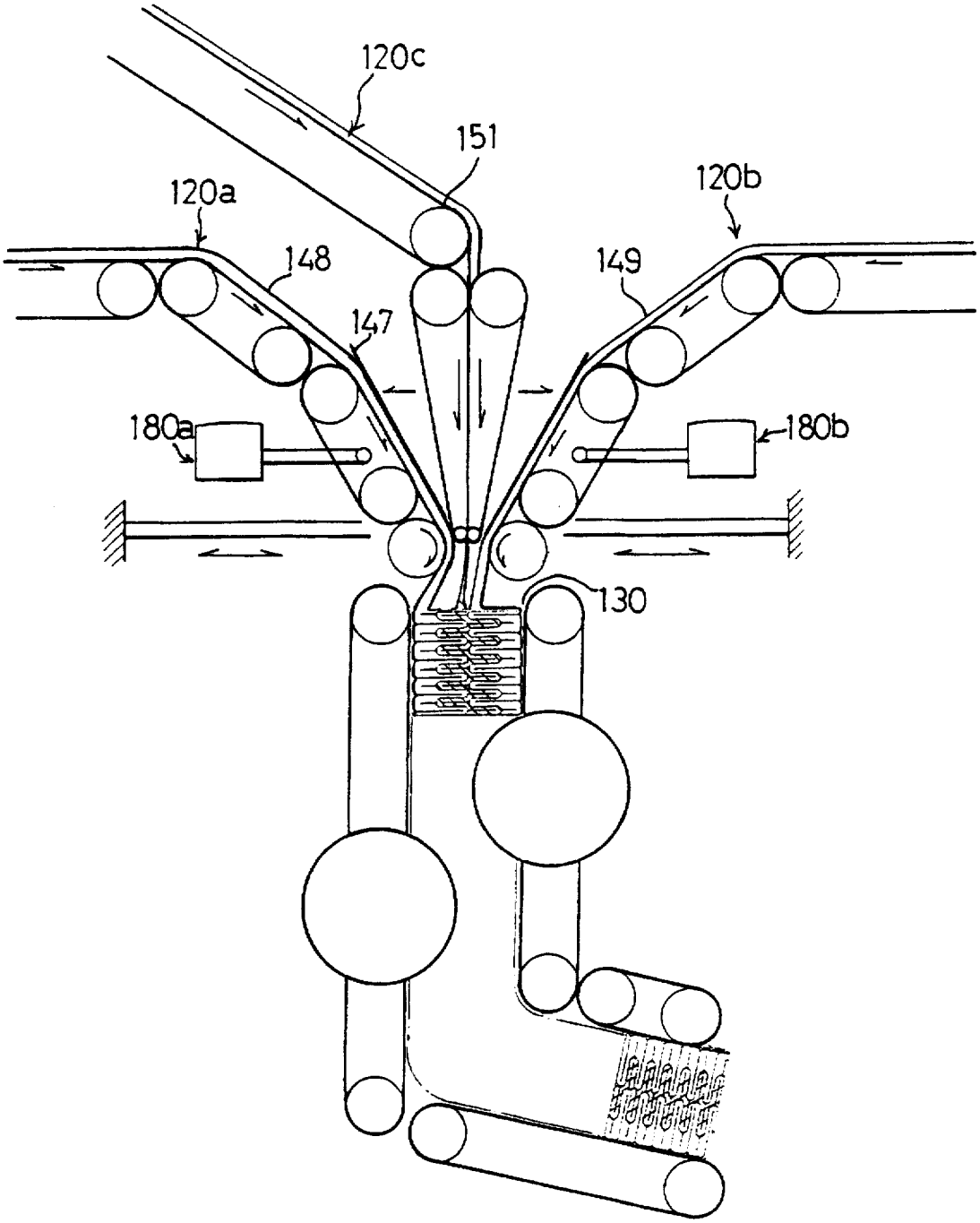
Figure 32:
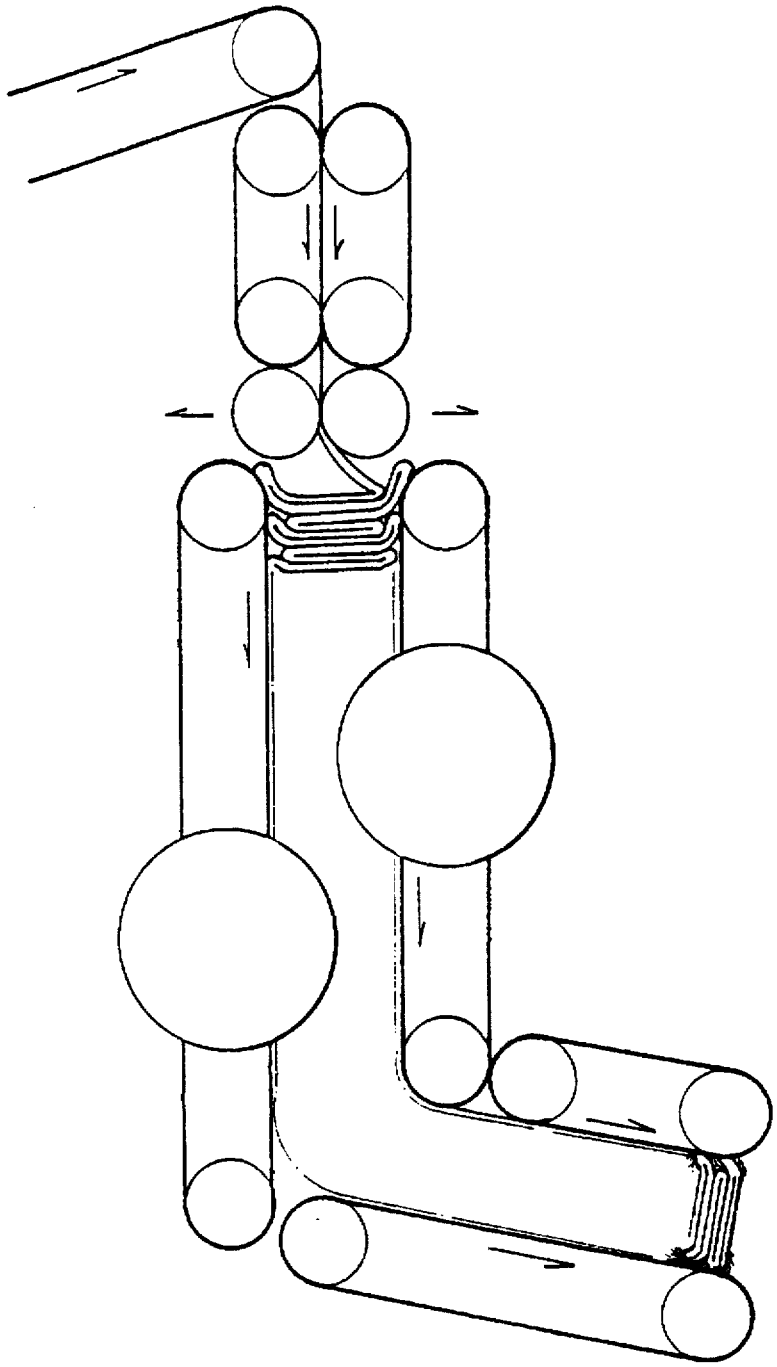
Figure 33:
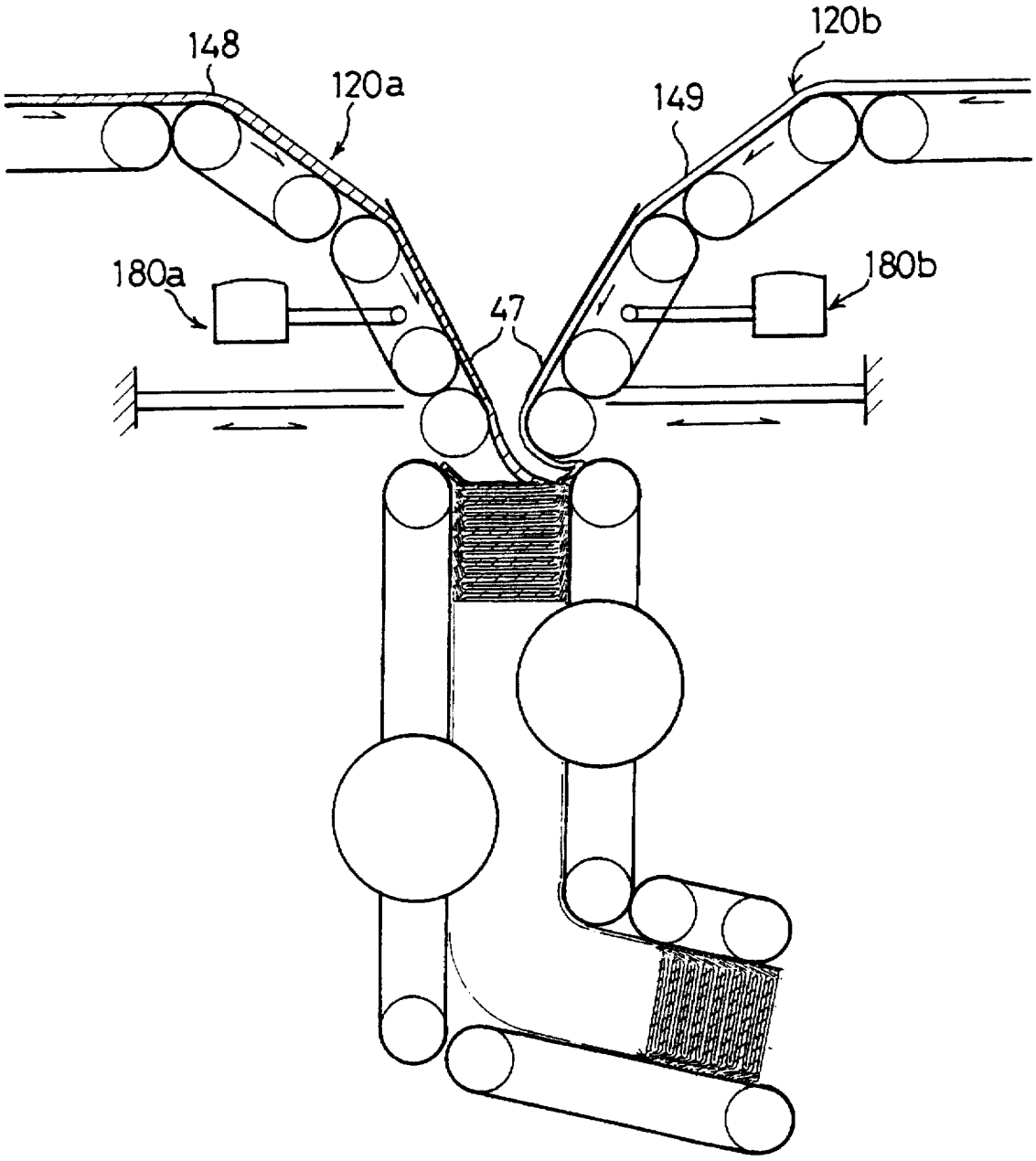
Figure 34:
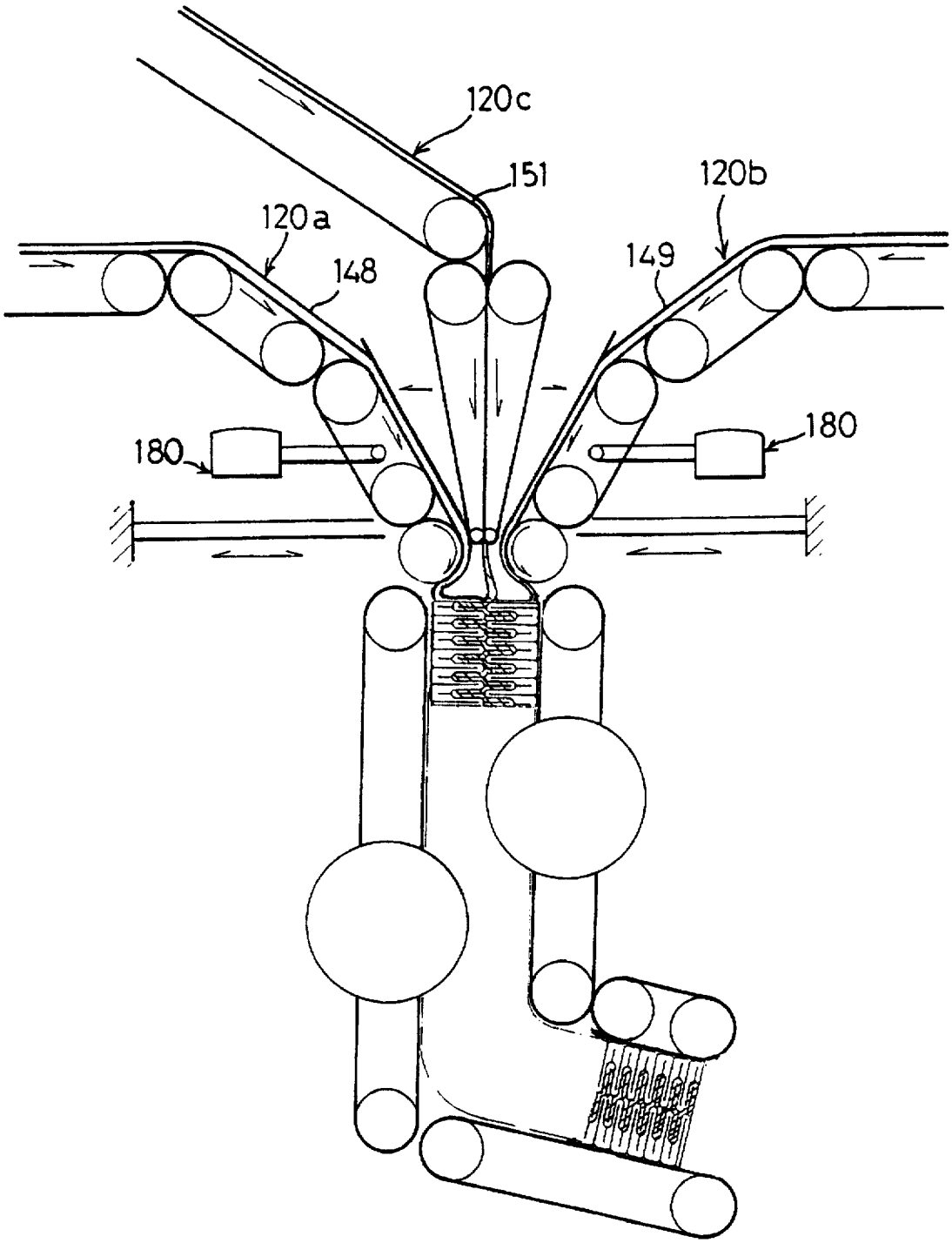

14 with respect to density gradients but having a somewhat arcuate configuration of the pleats;

FIG. 27 is a schematic view of a portion of an apparatus for forming a corrugated fiberfill structure with density gradients from a single fibrous web;

FIG. 28 is a schematic view of a portion of an apparatus for forming a corrugated fiberfill structure with density gradients from two fibrous webs;

FIG. 29 is a schematic view of a portion of an apparatus for forming a corrugated fiberfill structure of the invention similar to that of FIG. 28 but additionally provided with brushing devices;

FIG. 30 is a schematic view of a portion of an apparatus for forming a corrugated fiberfill structure with density gradients from three fibrous webs;

FIG. 31 is a schematic view of a portion of an apparatus for forming a corrugated fiberfill structure of the invention similar to that of FIG. 30 but additionally provided with brushing devices;

FIG. 32 is a schematic view of a portion of an apparatus for forming a corrugated fiberfill structure having a folded-over pleat configuration from a single fibrous web;

FIG. 33 is a schematic view of a portion of an apparatus for forming a corrugated fiberfill structure having a folded-over pleat configuration from two fibrous webs; and FIG. 34 is a schematic view of a portion of an apparatus for forming a corrugated fiberfill structure of the invention having a folded-over pleat configuration from three fibrous webs.

DETAILED DESCRIPTION OF THE PREFERRED EMBODIMENTS

Figure 1:
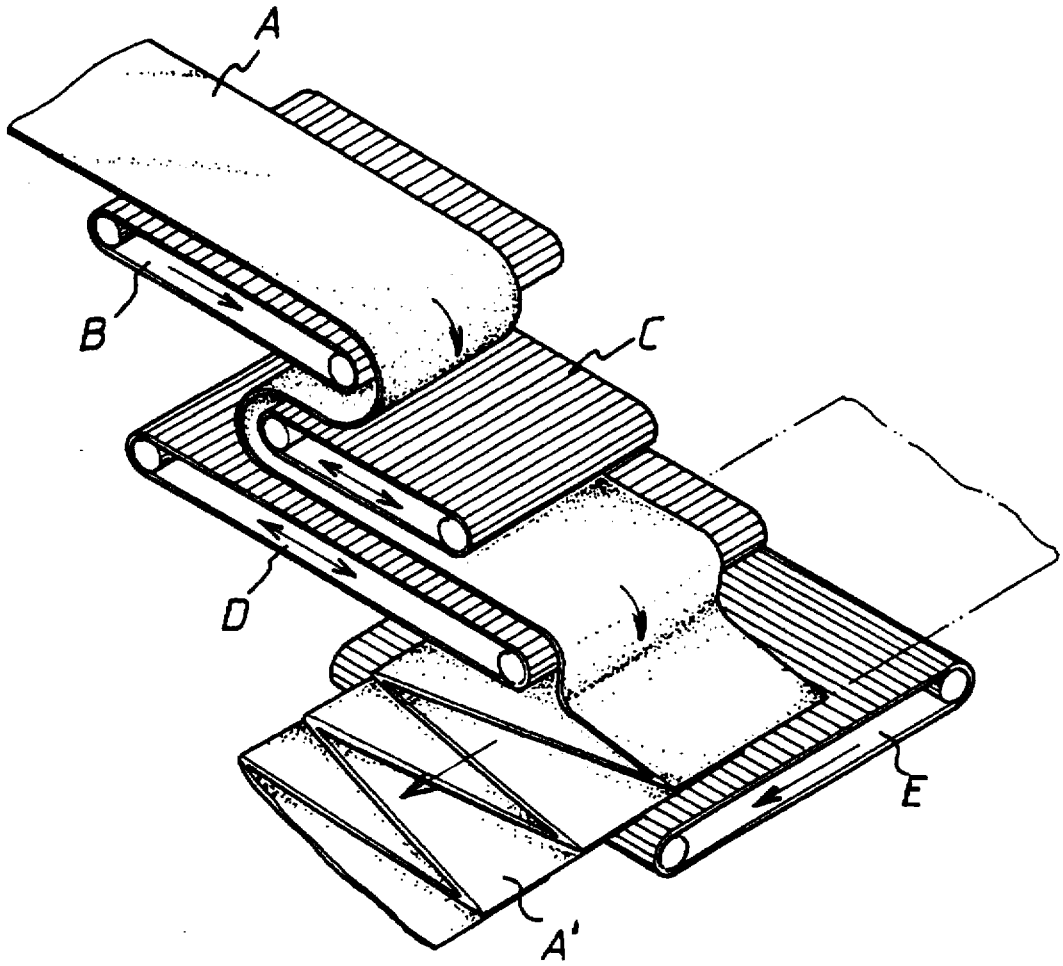
FIG. 1 PRIOR ART
FIG. 1 is a perspective view of a known cross-lapping machine.
Figure 2:
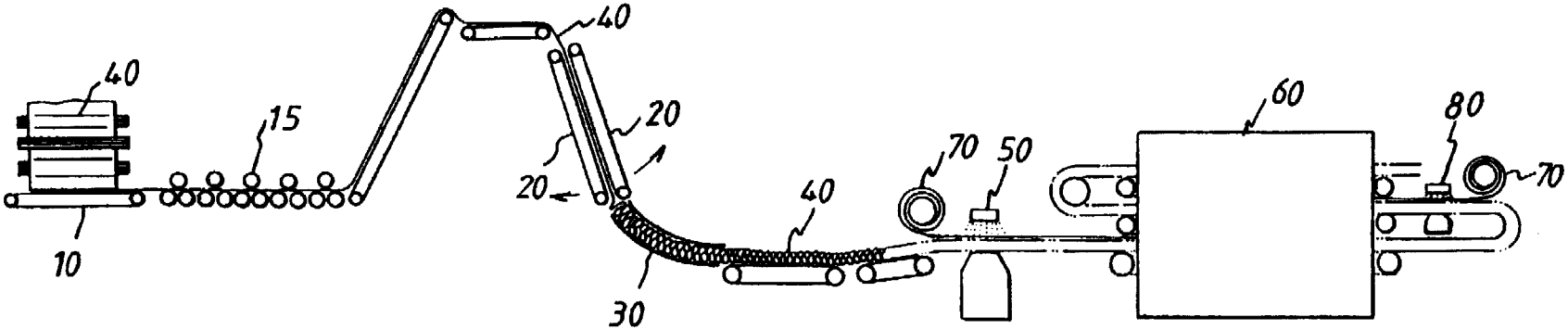
FIG. 2 is a schematic view of an apparatus for corrugating resin-bonded fiberfill according to the present invention.

Now referring to the drawings, initially to FIG. 2, a preferred embodiment of an apparatus for implementing a method for corrugating resin-bonded fiberfill in accordance with the present invention is shown. The method proceeds as follows.

A bale of fibers is initially opened, carded, and formed into a fibrous web, which is indicated by reference numeral 40. The fibrous web 40 is fed into a cross-lapping machine 10 which laps the fiber web 40 in alternating directions.

After leaving the cross-lapping machine 10, the fibrous web 40 is preferably drafted by a drafting machine 15, thereby increasing the longitudinal strength thereof. The fibrous web 40 is conveyed between a pair of parallel-spaced conveyor belts or rollers 20. The conveyor belts or rollers 20 pivot about an axis at the entrance thereto, (i.e., the belts or rollers are pivoting conveyor means) as shown by the arrows in FIG. 2, so that as the fibrous web 40 exits therefrom, the pivoting motion folds the fibrous web 40 at the laps formed by the cross-lapping machine 10, forming a corrugated structure as the fibrous web 40 enters a forming chamber or conveying passage 30, which typically contains one or more pair of parallel-arranged conveyors, such as conveyor belts. The conveying passage 30 has a height set at a predetermined height desired for the corrugations of the fibrous web 40 to yield the corrugated blanket. Thus, the cooperation of the pivoting conveyor 20 and the forming chamber 30 determines the height, pitch and orientation of the corrugations.

At this point, to the fibrous web 40, in the form of a corrugated blanket, is optionally applied a first outer web 1, which is conveyed from a first roller 70 and then passes into a spraying machine 50, where resin is sprayed onto one side of the first outer web 1. Then, the fibrous web 40 having the first outer web 1 thereon is heated and dried by an oven 60. Preferably, only a single heating step is used in the process. After leaving the oven 60, a second outer web 1, which is conveyed from a second roller 70, is applied to the fibrous web 40 and the fibrous web then passes into a spraying machine 80, where resin is sprayed onto the second outer web 1. Again, the fibrous web 40, having two outer webs 1 thereon, is heated and dried by the oven 60. The resin will adhere the corrugations 21, as shown in FIG. 5. The first and second outer webs 1 can be optionally applied to the fibrous web 40 after passing into the spraying machines 50 and 80, respectively. Alternatively, products possessing no sandwich structure, as shown in FIG. 4, can be manufactured by deleting the step of applying the two outer webs 1 on the fibrous web 40.

Figure 4:
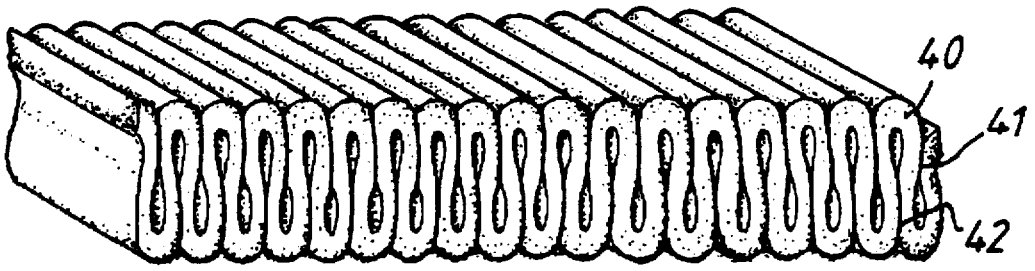
FIG. 4 is a perspective view of an improved structure of resin-bonded or thermo-bonded fiberfill according to the present invention.
Figure 5:
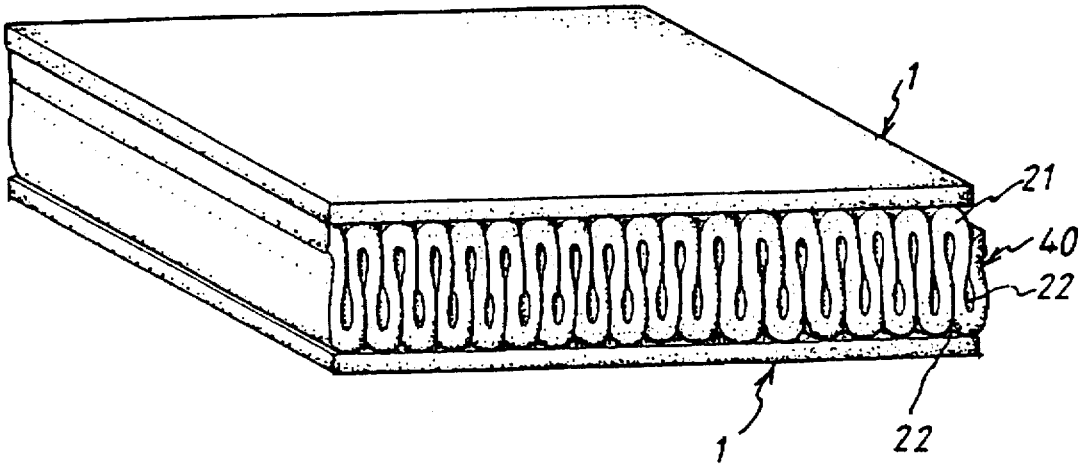
FIG. 5 is a perspective view of an embodiment of the present invention produced in accordance with apparatus shown in FIG. 3.

FIG. 4 provides a perspective view of the product having no sandwich structure. The fibrous web 40 possesses strength along the three-dimensional axes thereof, significantly increasing the strength and resilience of the overall structure. Furthermore, the spaces between the contact sites 41 and 42 of the corrugations allow resin to be uniformly dispersed and penetrate throughout the structure, which subsequently facilitates the drying and curing process.

Figure 3:
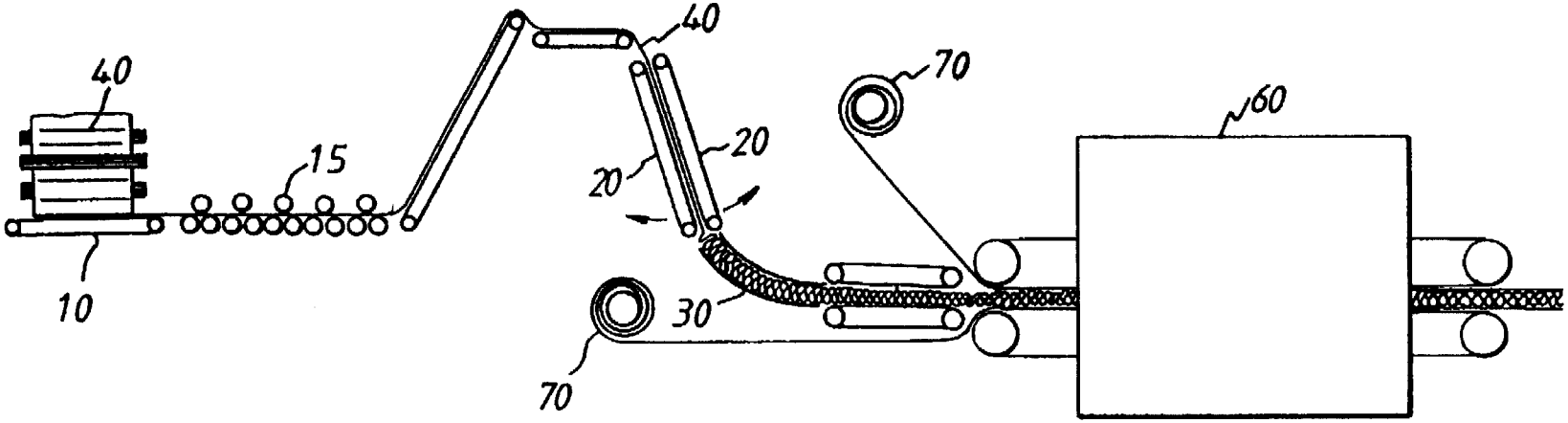
FIG. 3 is a schematic view of an apparatus for corrugating thermo-bonded fiberfill according to the present invention, optionally with another two outer webs adhering to the corrugated fiber web.

An alternate and preferred embodiment uses no resin. When no resin is added, according to the process schematically illustrated in FIG. 3, fibers of low melting point (second fibers) will be blended into regular fibers (first fibers) before the process is started. The molten fibers bond the corrugations and the regular fibers together. Upon cooling of the corrugated blanket, the melted fibers solidify to strongly bond the high melting fibers to one another as well as adjacent corrugations in mutual contact. Before passing into the oven 60, the corrugated fibrous web 40 is optionally sandwiched with a pair of transversely-positioned outer webs 1, respectively conveyed from two rollers 70. The sandwich structure passes into the oven 60, thereby bonding the outer webs 1 on the fibrous web 40.

The fiber source used in the practice of this preferred embodiment of the invention is a combination of low melting fibers and high melting fibers. The low melting fiber should melt at a temperature of at least 20°, preferably at least 30° C. below the melting temperature of the high melting fiber.

Fibers of the same or similar material can be used for both the low melting fibers and the high melting fibers, depending on the particular intended use and their combination with other fibers. For example, a polyamide fiber having a melting point of about 250° C. can be the low melting fiber when used in combination with aramid fibers having a melting point of greater than 280° C. (if they melt at all); and that same polyamide fiber can be the high melting fiber when used in the practice of this invention. Materials from which the fibers are formed include, but are not limited to: polyesters, such as polyethylene terephthalate (m.p. 250° C.); copolyesters, such as a copolyester of 60–80 mole percent ethylene terephthalate and 20–40 mole percent ethylene isophthalate (m.p. 110°–170° C.); polypropylene (m.p. about 160° C.); polyamides, such as nylon 6 (m.p. 220° C.) and nylon 66 (m.p. 254° C.); and aramids, such as poly (meta-phenylene isophthalamide) (decomposes) and poly (para-phenylene terephthalamide) (decomposes).

The low melting fibers can be of a so-called sheath-core construction wherein there is a core component and a lower melting sheath component. The lower melting sheath component serves, for the purpose of this invention, as the relatively low melting polymer.

The combination of fibers is generally 10 to 40 weight percent low melting fibers. It has been found that a concentration of low melting fibers which is less than 5 weight percent will not yield a strongly bonded structure; and a concentration which is greater than 50 weight percent will yield a structure which is stiff and has a harsh hand.

Figure 6:
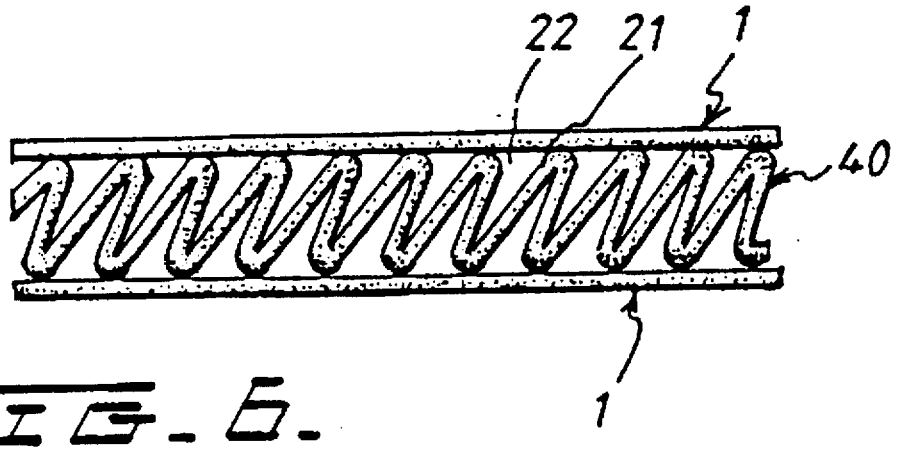
FIG. 6 is a side view of another embodiment in accordance with the present invention, wherein a fiber web has a saw tooth-like corrugated arrangement.
Figure 7:
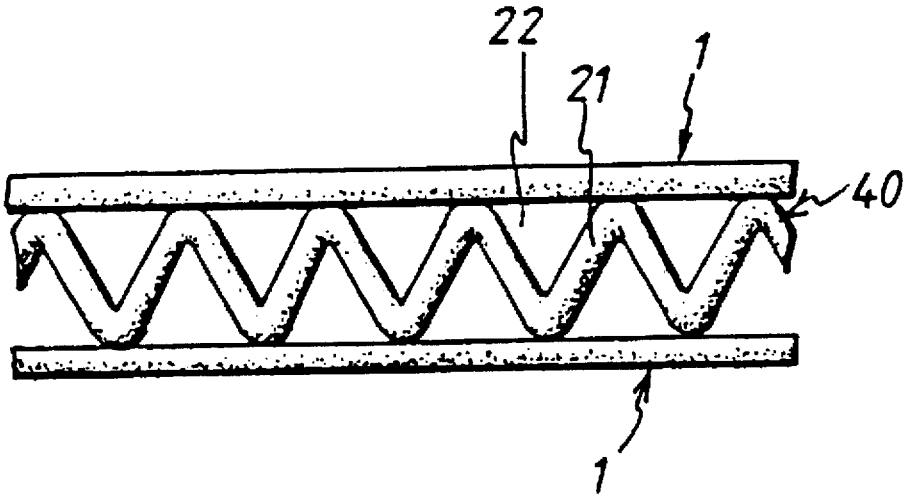
FIG. 7 is a side view of yet another embodiment in accordance with present invention, wherein the fiber web is triangularly corrugated.

Preferably as shown in FIG. 5, corrugations 21 of the fibrous web 40 are arranged accordion-like, where top and bottom ends thereof are generally rounded, with respective inner and outer spaces 22 formed between respective corrugations 21 and the outer webs 1. Also, in accordance with the present invention, the corrugations 21 of the fibrous web 40 can be saw tooth-shaped or triangularly-shaped, as respectively shown in FIGS. 6 and 7.

Additional embodiments of the present invention are illustrated in FIGS. 8 to 11. These embodiments are variations of the resin-bonded and thermo-bonded corrugated structures and methods of making such structures described above. Each of these modified embodiments involves brushing peaks 23 of the corrugations 21, thereby causing fibers 45 at or adjacent the peaks 23 of the corrugations to be pulled loose from the fibrous web 40, orient themselves across the gaps 22 existing between the peaks 23 of the corrugations to contact, and possibly become entwined with the fibers 45 of the adjacent peak 23 of the fibrous web 40. The brushing step of the present invention is conducted after the alternately lapped fibrous web is folded so as to form a corrugated fibrous web and before either resin is applied to the corrugated web in the formation of a resin-bonded corrugated fibrous web or the heating step in the formation of a thermo-bonded corrugated fibrous web.

To obtain the bridging, corrugated, fibrous webs of the present invention, the peaks 23 are brushed once the corrugated structure is formed. This is achieved by locating one or more brushing apparatus or brushes 90 within the conveying passage or forming chamber 30. The forming chamber 30 includes at least one pair of parallel-spaced conveyors 31 at the downstream end of which is positioned one or more brushing apparatus 90.

Figure 8:
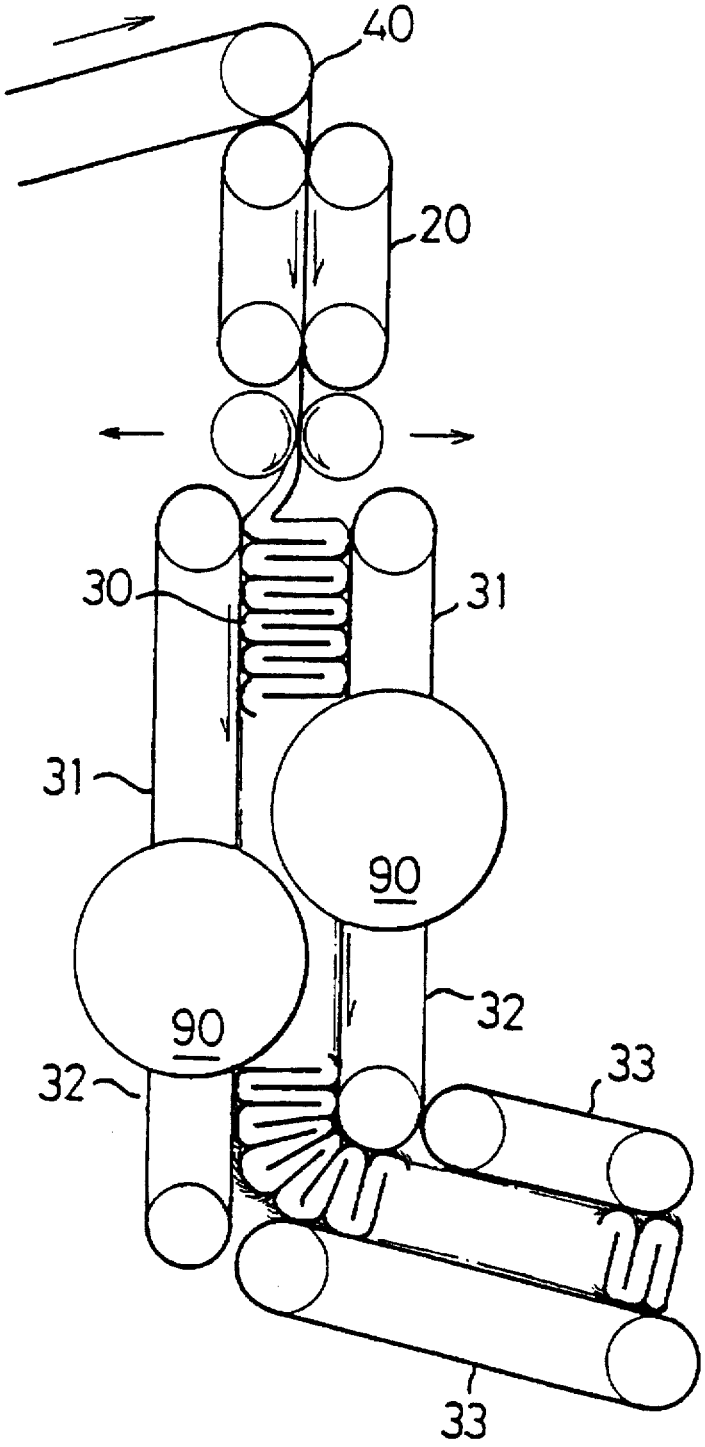
FIG. 8 is a schematic view of the portion of an apparatus for corrugating resin-bonded or thermo-bonded fiberfill according to an embodiment of the present invention.

Preferably, as illustrated in FIG. 8, the system of the present invention employs at least two pair of parallel-spaced conveyors, such as conveyor belts 31, 31'; 32, 32'; and 33, 33', arranged in series in the conveying passage 30. Preferably, the brushing apparatus 90 is positioned between first and second pairs of parallel-arranged conveyors. Optionally, additional brushing apparatus may be located intermediate successive pairs of parallel-spaced conveyors. While each individual conveyor in a pair of parallel-spaced conveyors, such as 31, 31'; 32, 32'; or 33, 33', may be of the same length, as measured in the direction of movement of the fibrous web 40, it is preferred that the length of each conveyor be different. This permits a skewed arrangement of each brushing apparatus 90 as illustrated in FIG. 8. In such an arrangement, while a brushing apparatus 90 is applying force to a peak 21 on one side of the corrugated fibrous structure, support is provided by the belt of the conveyor on the opposite surface of the moving, corrugated fibrous web.

Various types of brushing apparatus may be employed in the present invention. Examples of such brushing apparatus are illustrated in FIGS. 9A to 9D. The particular type of brushing apparatus selected and positioning with respect to the peaks 23 of the corrugations of the fibrous web 40 are based, at least in part, on variables such as the material from which the fibrous web is formed, the length of the fibers, the density of the fibrous web, how tightly the corrugations are arranged, etc. Exemplary of the types of brushes employed as the brushing apparatus 90 include rotating brushes 91, of the type illustrated in FIG. 9A in which radially-oriented bristles rotate about an axis.

An alternative embodiment is illustrated in the conveyor brush 92 or FIG. 9B. In the conveyor brush 92, a conveyor belt is provided with outwardly projecting bristles. The conveyor belt being mounted on and extending between a rotating, driving wheel or pulley and a driven wheel or pulley. Although the rotating and conveyor brushes, 91 and 92, respectively, may be arranged so as to rotate in the direction of movement of the corrugated fibrous web 40, it is generally preferred that rotation occur in the direction opposite that of the direction of movement of the corrugated fibrous web 40, as illustrated by the arrows shown in FIGS. 9A and 9B.

Other exemplary types of brushes suitable for use in the present invention include the fixed brush 93 illustrated in FIG. 9C and the air "brush" 94 illustrated in FIG. 9D. The latter type of brushing apparatus includes one, or a plurality of nozzles oriented toward the surface of the peaks 23 of the corrugations. As with the rotating brush, the nozzles of the air brush 94 are preferably oriented counter to the direction of movement of the fibrous web 40. Air, under suitable pressure, is passed through the nozzles in a manner to lift ends of fibers 45 from the surface of the fibrous web 40, in a manner similar to that achieved by the brushing devices 91 to 93. A single difference between the air brush 94 and the brushing devices 91 to 93 is that in addition to locating the air brush between adjacent conveyors, such as 31 and 32, if a conveyor is provided having the form of an open mesh, the air brush may be located within the space defined by the endless loop of the conveyor belt. In such an instance, air passes through the nozzle(s) of the air brush 94 and contacts the fibers 45 after passing through the open mesh of the conveyor belt.

Figure 11:
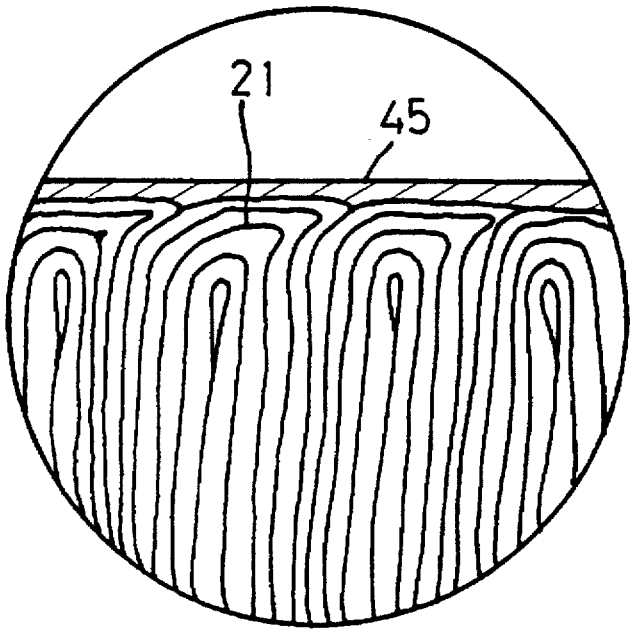
FIG. 11 is an enlarged portion of the region of the fiberfill product illustrated in FIG. 10 at the peaks of the fiberfill portion.
Figure 10:
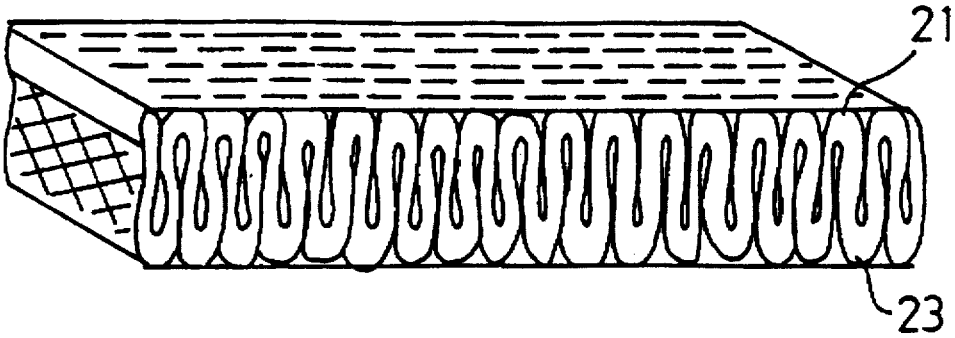
FIG. 10 is a perspective view of the fiberfill material produced with the apparatus of FIG. 8.

As illustrated in FIGS. 9A to 9D, showing the various brushing devices in an embodiment of the process of the present invention, and in FIGS. 10 and 11, which illustrate the fiber-bridging corrugated fibrous webs of the present invention, it may be seen that portions of fibers 45 extend from peaks 23 or a region of a corrugated fibrous web 40 adjacent such peaks, to adjacent corrugated peaks 23, bridging the gaps 22 between adjacent corrugations.

In effect, the brushing frees ends of fibers 45 from the fibrous web and "sweeps" the free ends of the fibers to adjacent peaks of the corrugated web. While freeing one end of a fiber to bridge the gap 22 between the corrugations 21, the remaining portions of the fibers 45 remain anchored to the original top of the peak 23 or region of the fibrous web 40 adjacent thereto. Once resin is applied to the pleated fibrous web and cured, or heat is applied to the pleated fibrous web in the thermo-bonded embodiment so as to bond various fibers together, the bridging fibers 45 serve as an outer web between which the corrugated fibrous web 40 is sandwiched. Thus, while additional transversely-positioned outer webs 1 may be applied to the outer surface of the bridging fibers 45, this is frequently unnecessary since the bridging fibers 45, after curing of the resin or melting and subsequent solidification and bonding of fibers in the thermo-bonding embodiment, achieve, among others, many of the objects of the embodiments described above having the transversely-positioned outer webs 1, without the additional step of applying the transversely-positioned outer webs nor the associated complexity of including apparatus for applying the webs. Nonetheless, in some instances, it may be desirable to not only include the fiber-bridging corrugated fibrous web, but also include such structure sandwiched between a pair of transversely-positioned outer webs 1 or to affix such transversely-positioned outer web 1 to a single surface of the bridging fibers 45.

Overall, the structure of the present invention has a high degree of air permeability, anti-compression, and loftiness, and is useful in quilts, pillows, cushioned seats, cushions, mattresses, sleeping bags, snow clothing, etc. and as filtering material.

Particular advantages realized by the fiber-bridging corrugated fibrous structures of the present invention include structures having a smooth and even surface resulting from at least partially filling the gaps between adjacent pleats of the structure. The fiber-bridging structures also have improved machine directional strength as compared to conventional structures, resulting from the increased bonding of adjacent pleats, while still retaining the strength and structural properties related to the vertical portions of each pleat.

In resin-bonded structures, application of the resin to only the surface portions of the fiber-bridging pleated structures is necessary to provide additional structural integrity to the corrugated structure. By such application of resin to only the surfaces, a low density structure having good "stuffability", high bulk recovery in an unloaded state, and low bulk under load, as well as being extremely soft may be formed. Such material is suitable for products such as comforters, sleeping bags, and apparel, providing good insulation and suitable hand. This may be compared with conventional corrugated products which must be saturated with resin to provide suitable, structural integrity. Such saturated resin products possess high density and may be used for the manufacture of mattresses and furniture cushions, but not the types of low density products for which an embodiment of the fiber-bridging resin-bonded, corrugated structures of the present invention may be used.

In the fiber-bridging, thermo-bonded corrugated fiber structures of the present invention, in addition to the machine directional strength achieved by the bridging fibers, such bridging fibers also serve as a frame which holds the corrugations in place. As a result, the structure does not need the corrugations arranged in a closely spaced arrangement as required by conventional corrugated structures. This also results in softer, lower density material suitable for sleeping bags and apparel.

Another aspect of the present invention relates to a corrugated or pleated fiberfill structure which includes density gradients across the thickness of the corrugated web. Such structures are formed from at least one fibrous web folded to form a plurality of pleats having alternating crests and bases. The crests of at least some of the pleats define a first surface and the bases of at least some of the pleats define a second surface. In this aspect of the present invention, density gradients exist across the thickness defined between the two surfaces. With reference to FIGS. 12 to 25, various embodiments of this aspect of the invention will be discussed.

Figure 12:
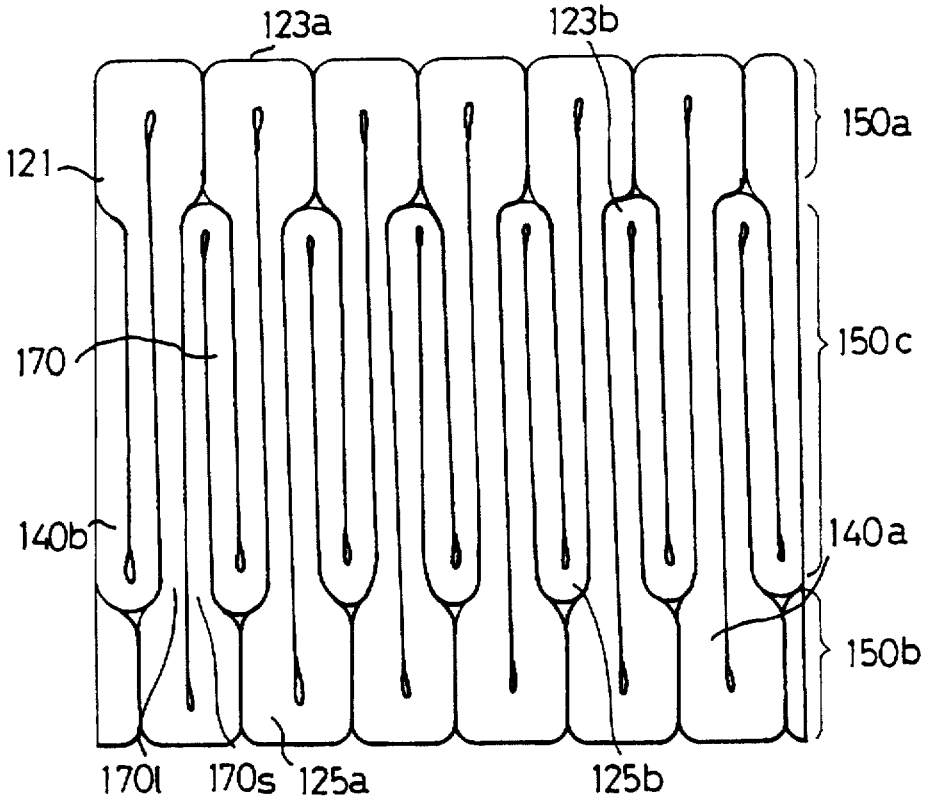
FIG. 12 is a side view of an embodiment of the corrugated fiberfill structure of the invention having low density regions adjacent the surfaces of the structure and a medium density region therebetween.

FIG. 12 illustrates an embodiment of the invention in which an upper portion of the corrugated structure adjacent the peaks or crests 123*a*, defining the upper surface of the corrugated fiberfill structure, provide a low density region 150*a*. Likewise, the bases or troughs 125*a* define a lower surface of the corrugated fiberfill structure of the present invention in which the bases 125*a* of the pleats 140*a* also define a low density region 150*b*. Intermediate the low density regions adjacent the upper and lower surfaces of the corrugated structure is located a middle or medium density region 150*c*. Accordingly, in the embodiment illustrated in FIG. 12, the medium density region 150*c* is located remote from either surface of the structure at approximately the center of the thickness or cross-section of the corrugated structure between the low density regions 150*a* and 150*b*. The different density distributions illustrated in the drawings represent different degrees of softness and support. The degree of softness of a particular corrugated structure or portion thereof varies inversely with the density while the degree of firmness or support varies directly with the density of the structure or region of the structure. That is, the lower the density of the structure, the higher is the sensation of softness and vice versa. The higher the density of a medium or region thereof, the greater is the sensation of support or firmness.

In the embodiment illustrated in FIG. 12, having pleats 140*a* which extend between upper and lower surfaces, as defined by crests 123*a* and bases 125*a*, are pleats 140*b* having crests 123*b* and bases 125*b*. It may be noted that these crests 123*b* and bases 125*b* do not extend to the outer surface of the fiberfill structure. It may also be noted that each of the pleats is formed from two legs of unequal length, 170*l* (long) and 170*s* (short), the inner surfaces of which contact one another and the outer surfaces of which contact at least a portion of the leg of an adjoining pleat. At least conceptually, each pleat which is formed by 170*l* and 170*s*, may be thought of as being connected by a shorter joining leg, designated 170*j*, which is shorter than and lies intermediate while joining 170*l* and 170*s*.

Figure 13:
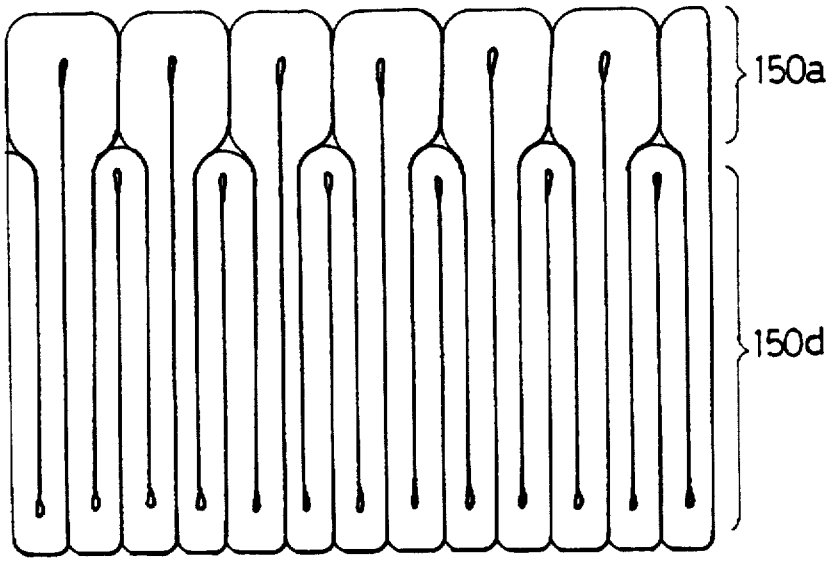
FIG. 13 is a side view of another embodiment of the corrugated fiberfill structure of the invention having a low density region adjacent one surface of the fiberfill structure with the remaining portion of the structure having a high density.

The embodiment of the invention illustrated in FIG. 13 contains a single low density region 150*a* adjacent one surface of the corrugated structure. The remaining portion of the corrugated structure, extending from the low density region to the opposite surface of the structure is a high density region 150*d*.

Figure 14:
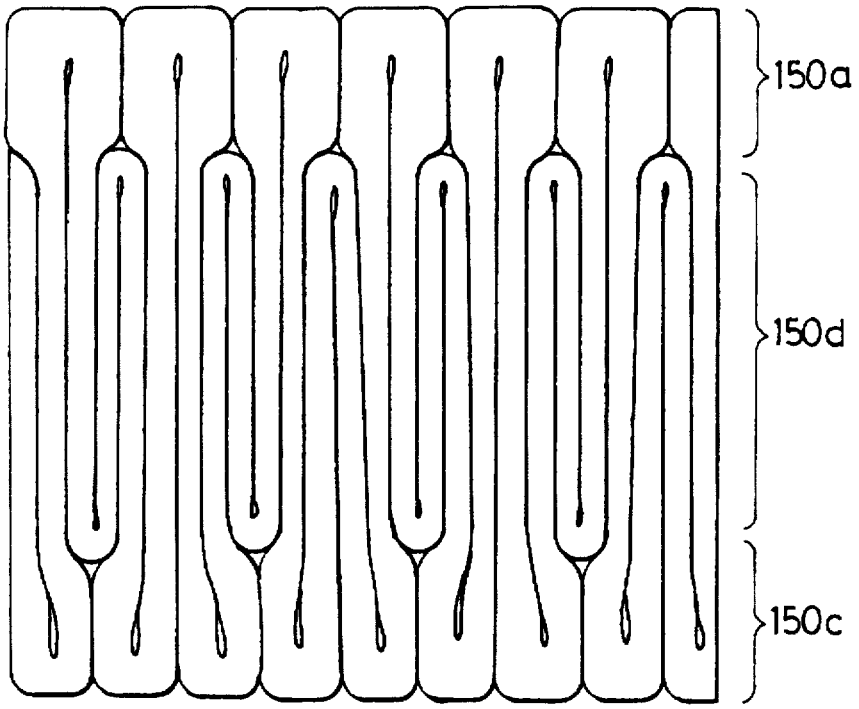
FIG. 14 is a side view of an embodiment of the corrugated fiberfill structure of the invention having a high density region intermediate a low density region and a medium density region.
Figure 15:
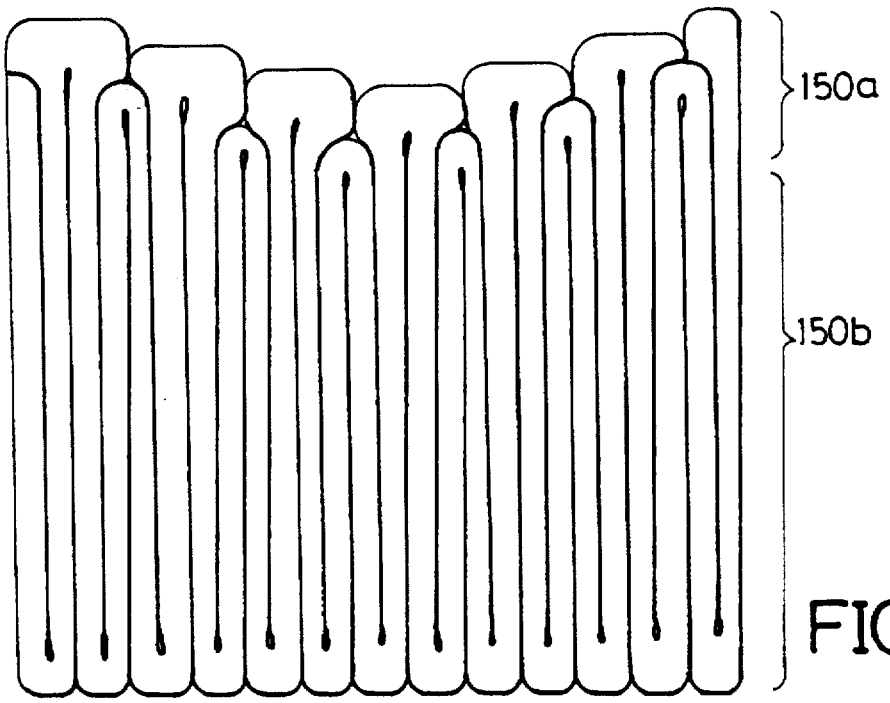
FIG. 15 is a side view of an embodiment of the corrugated fiberfill structure of the invention similar to that of FIG. 13 but in which the thickness of the structure varies over its length.

FIG. 14 illustrates another embodiment of the present invention which includes a low density region 150*a* adjacent one surface of the corrugated structure, a medium density region 150*c* adjacent an opposite surface of the corrugated structure and a high density region 150*d* located remote from either surface of the structure, intermediate the low and medium density regions. FIG. 15 is similar to FIG. 13 in that it contains both a low density region 150*a* and a high density region 150*d*. However, the embodiment of FIG. 15, unlike the embodiments of FIGS. 12 to 14 which have substantially planar surfaces, includes a non-planar surface adjacent the low density region which is not parallel to the surface adjacent the high density region.

Figure 16:
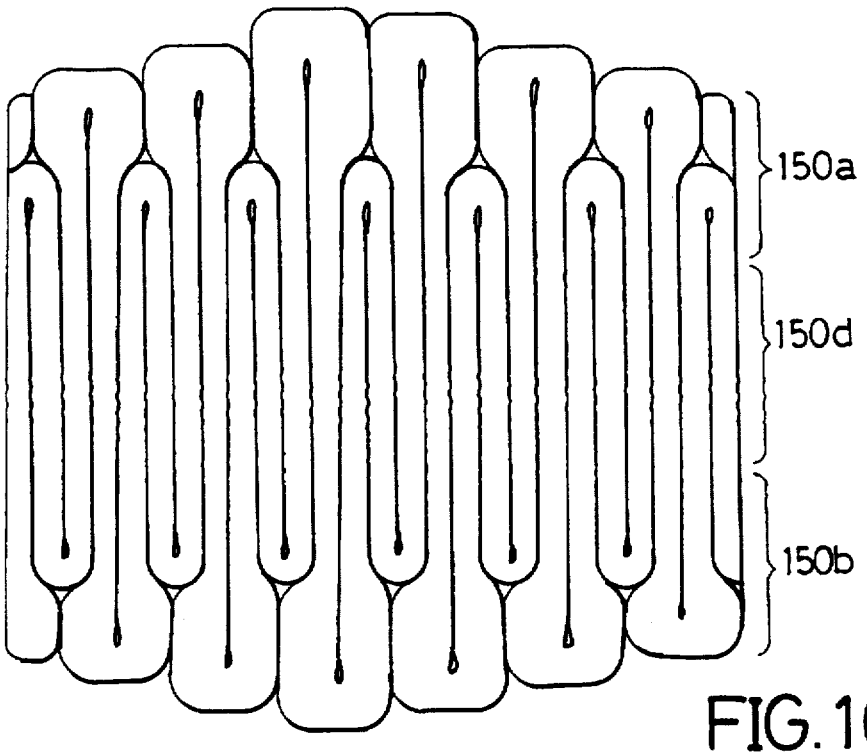
FIG. 16 is a side view of another embodiment of the corrugated fiberfill structure of the invention similar to FIG. 15 but in which neither opposing surface is flat and having a high density region intermediate two low density regions.

FIG. 16 includes a high density region 150*d* located intermediate two low density regions 150*a* and 150*b*, disposed at opposite surfaces of the corrugated structure. Each of the surfaces is non-planar and not parallel to the opposite surface.

Figure 17:
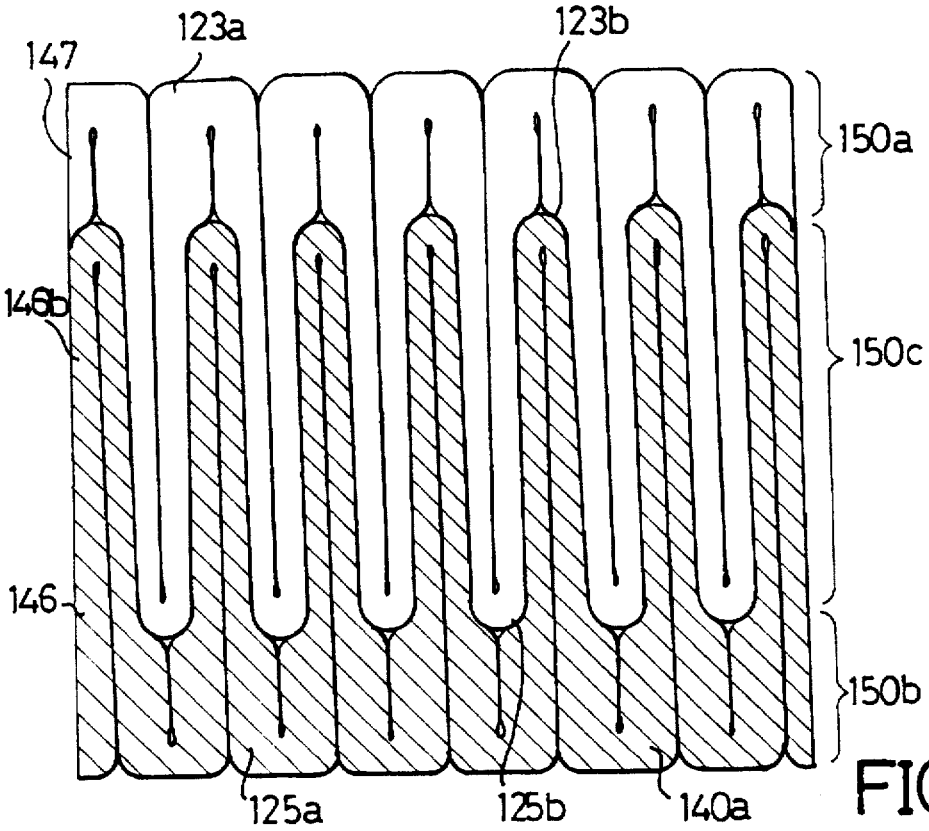
FIG. 17 is a side view of an embodiment of the corrugated fiberfill structure of the invention similar to FIG. 12 but formed from two engaging pleated webs.
Figure 18:
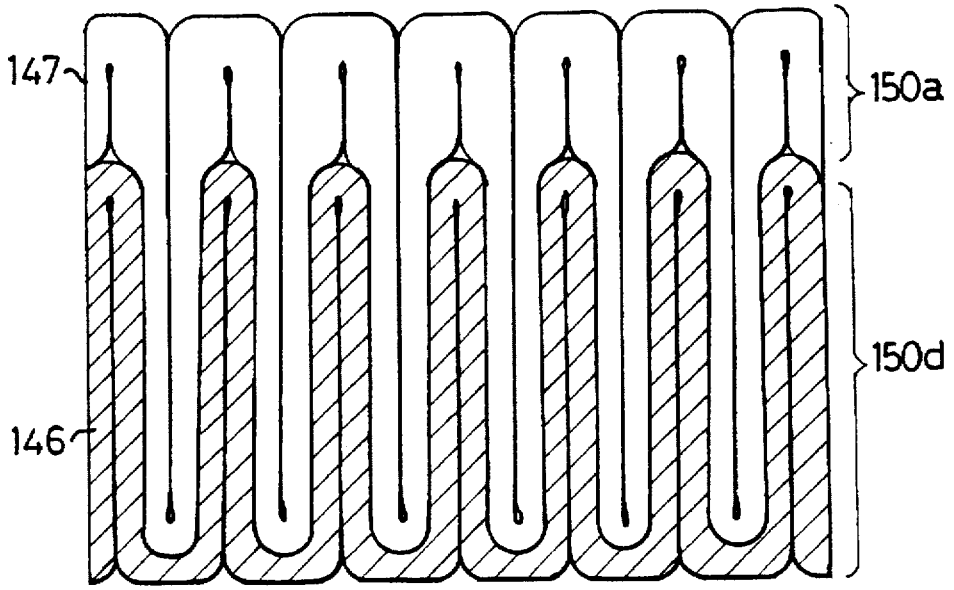
FIG. 18 is a side view of another embodiment of the corrugated fiberfill structure of the invention similar to FIGS. 13 and 17.

In each of the embodiments of FIGS. 12 to 16, a single fibrous web is used to form the structures. However, the corrugated structures according to the present invention, which includes density gradients or varying density regions between the opposed surfaces of the corrugated structure may be formed from a plurality of fibrous mats or webs. Examples of embodiments which are formed from two separate fibrous mats are illustrated in FIGS. 17 and 18. Thus, a first fibrous web 147 is corrugated such that the pleats thereof engage or enclose pleats of a second fibrous web 146. Embodiments of the present invention employing two fibrous webs can be constructed to provide various combinations of low density, medium density and high density regions. Exemplary of one combination is the embodiment of FIG. 17, which is similar to that of FIG. 12 in that it contains a medium density region 150c located remote from either surface of the structure, intermediate low density regions 150a and 150b. Similarly, the embodiment of the invention illustrated in FIG. 18 which includes two different fibrous webs engaging or interlocking one another in a pleated structure, like the embodiment illustrated in FIG. 13 including a single web, also is provided with a low density regions 150a and a high density region 150d located remote from either surface of the structure.

Figure 19:
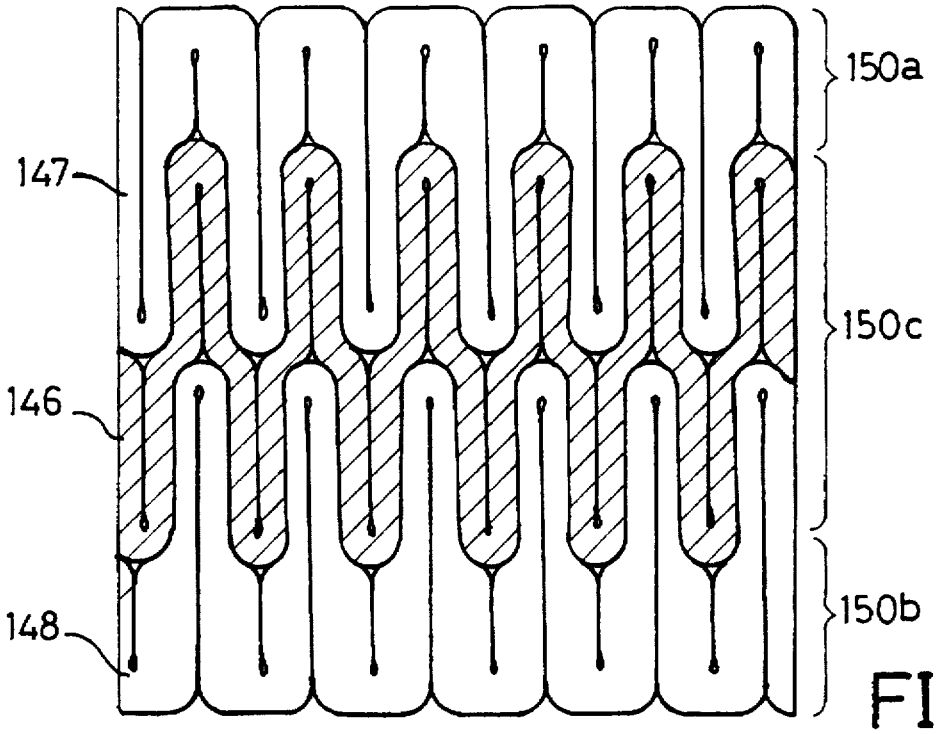
FIG. 19 is a side view of an embodiment of the corrugated fiberfill structure of the invention formed from three engaging pleated webs.
Figure 20:
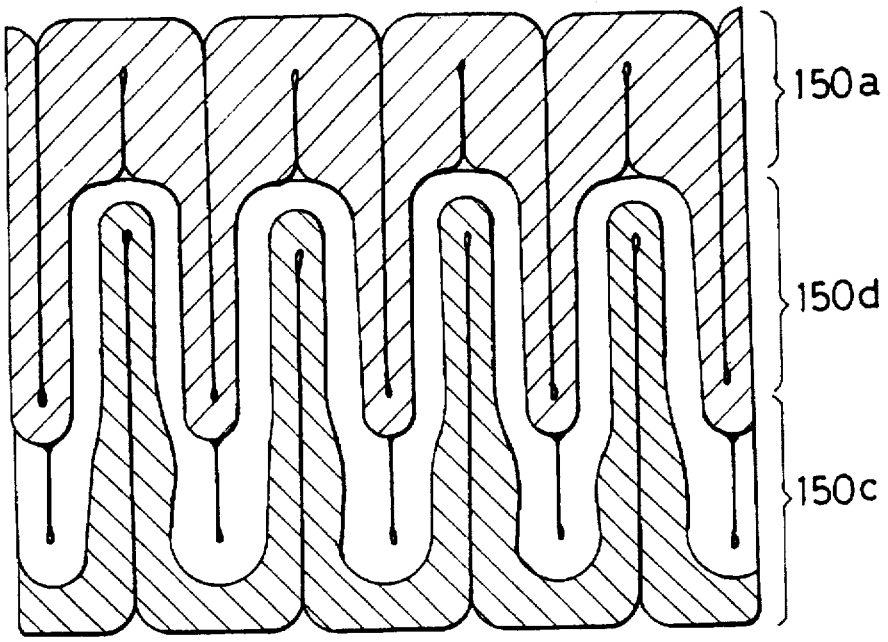
FIG. 20 is a side view of another embodiment of the corrugated fiberfill structure of the invention similar to FIGS. 14 and 19.
Figure 21:
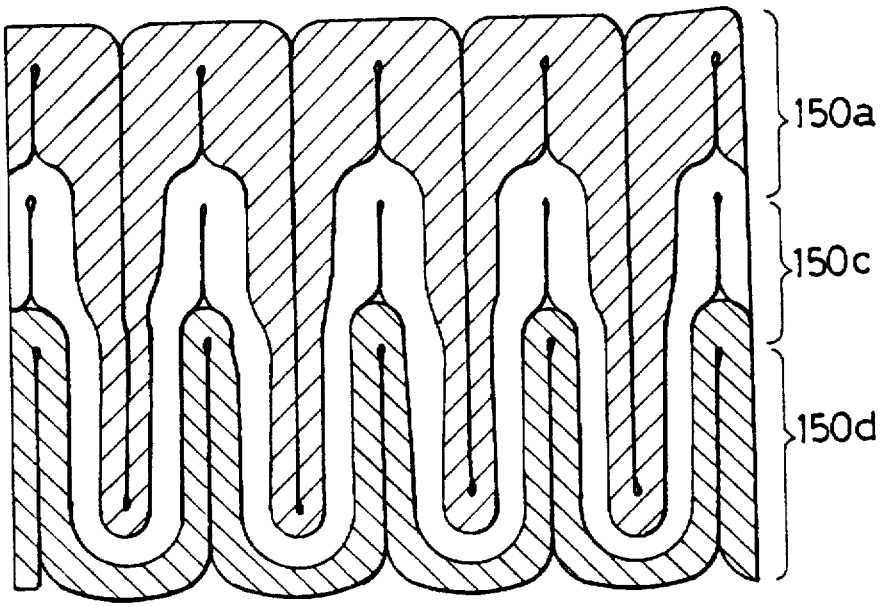
FIG. 21 is a side view of another embodiment of the corrugated fiberfill structure of the invention similar to FIG. 19 but having a medium density region located intermediate a low density region and a high density region.

The present invention is not limited to employing two separate fibrous webs. As illustrated in FIGS. 19, 20 and 21, three separate fibrous webs, 146, 147, 148 are corrugated together to form a corrugated fibrous structure having varying density regions between the surfaces of the corrugated structure. Like the embodiments illustrated in FIGS. 17 and 18, the different fibrous webs may interlock or engage one another. In the embodiments illustrated, an intermediate fibrous web 146 is sandwiched between and engages outer fibrous webs 147 and 148. FIGS. 19 to 21 also illustrate that the low, medium and high density regions may be varied across the thickness of the corrugated structure to suit a particular application. Generally, at least one low density region is arranged adjacent a surface of the structure.

The corrugated fiberfill structures of the present invention may be provided with surfaces which are planar, and which may be parallel to one another, or diverge from a planar configuration. This is illustrated in FIGS. 12 to 14, 17 and 18 with structures having planar surfaces. However, in the embodiments of FIGS. 15 and 16, at least one surface diverges from a planar configuration. The overall shape of the surfaces of the corrugated structure can be determined by adjusting the reciprocating movement of the driving device. If each length of the reciprocating movement is identical, then the overall shape provides parallel plane surfaces to the structure. If, however, the length of the reciprocating movement is programmed to increase or decrease, then the surface will tend to have a crown or well, rather than be planar.

The foregoing aspect of the present invention, i.e., those corrugated structures exemplified by the embodiments illustrated in FIGS. 12 to 21, may be prepared using apparatus such as those depicted in FIGS. 8 and 27 to 31. The simplest types of device, used to prepare corrugated structures such as those illustrated in FIGS. 1 to 16, are depicted in FIGS. 8 and 27. This employs a single pair of parallel spaced conveyor belts or rollers 20, as described above. The fibrous web 40 is supplied to the conveyor belts or rollers 20 which are then pivoted or moved in a reciprocating movement by a driving or pivoting device (not shown). This effectively causes the fibrous web 40, upon exiting the pivoting conveyor means 20 to form a corrugated structure as the web enters the forming chamber or conveying passage 30. In the conveying passage 30, brushing devices 91 to 93 (as illustrated in FIG. 8) may be provided to brush peaks 23 of the corrugations 21 to cause fibers 45 at or adjacent the peaks 23 of the corrugations to be pulled loose from the fibrous web 40 and orient themselves across gaps existing between the peaks 23 of the corrugations to contact, and possibly become entwined with, the fibers 45 of adjacent peaks 23 of the fibrous web 40.

Any desired density distribution may be obtained by preprogramming a control device (not shown) which causes the reciprocating movement to take place in a predetermined pattern. The actual pivoting or movement of the pivoting conveyor means 20 is controlled by a driving device, such as that illustrated in FIGS. 28 to 31 by reference numeral 180, which may take the form of a cam or a servomotor. The driving means and the program associated with the driving means (such as the shape of the cam) and the velocity or rate at which the driving cam is operated, determines the position of the folds and, concomitantly, the density distribution between the opposed surfaces of the corrugated structure defined by the peaks (or crests) and troughs (or bases) of at least a portion of the pleats.

The program by which the driving means or reciprocating device is operated determines the degree of overlapping per length of fibrous web supplied. The greater the reciprocating movement of the conveying means within a particular region of the thickness of the corrugated structure within a specific period or cycle, the greater is the degree of overlapping obtained. As a result, the more overlapping occurring within a particular region, the higher is the density in that particular region of the corrugated structure. For example, the embodiment illustrated in FIG. 12 has a low density region associated with the portions of the corrugated structure adjacent the opposed surfaces of the structure and a medium density portion located therebetween. This is achieved by programming the driving device to increase the number of reciprocating movements at the center of its range of movement. In contrast, the embodiment illustrated in FIG. 14 requires the highest number of reciprocating movements, thereby causing the highest density, at close to the center of the range of the driving device, with the least number of reciprocating movements at one end of the device's range corresponding to the low density region.

In the embodiments illustrated in FIGS. 17 to 21, the density distribution of the structure can be predetermined not only by appropriately selecting the degree of overlap of the pleats but also may be controlled by choosing different types of fibers and specific diameters or weights of fibers. Thus, in many applications it may be desirable to use more than one fibrous web in forming the corrugated structure of the present invention in which the physical characteristics of the fibers and/or webs, such as fiber diameter or density, differ from one another. Other properties of the corrugated structure may also be varied to suit a particular application by employing a plurality of fibrous webs.

The number of fibrous webs employed in the corrugated structures of the present invention is determined by the number of conveying means employed. FIGS. 28 and 29 illustrate apparatus provided with two conveying means 120a and 120b. The apparatus illustrated in FIG. 29 differs from that shown in FIG. 28 in that the former includes a brush apparatus 90, such as that described above and illustrated in FIG. 8. By employing two fibrous webs, fibrous web A, 148, and fibrous web B, 149, the density cross-section, or density gradients between the surfaces of the corrugated fiberfill structures of the present invention may be varied in two ways. That is, the structures can be varied by altering the corrugation pattern, i.e., the distribution of pleats in the structure to produce regions of higher or lower density, such as the embodiments illustrated in FIGS. 12 to 16. Additionally, employing fibrous webs A and B, which differ in density from one another, further density differences may be achieved across the thickness of the corrugated structure.

The apparatus illustrated in FIGS. 28 and 29 is similar to that illustrated in FIGS. 8 and 27. However, rather than using a single conveying means, two conveying means 120a, 120b, such as sets of conveyor belts or rollers are employed. In this embodiment, the fibrous webs 148 and 149 are supplied to the conveying means 120a and 120b, respectively. Each conveying means preferably includes a series of rollers or conveyor belts and guide plates 147 to maintain the fibrous web in contact with the rollers and/or conveyor belts, thereby assuring smooth and uninterrupted feed to the forming chamber 130, which is similar in construction to the forming chamber 30, described above.

In addition to the use of two conveying means, 120*a*, 120*b*, the apparatus illustrated in FIGS. 28 and 29 differ from those illustrated in FIGS. 8 and 27 in that they include individual driving means 180*a* and 180*b*, respectively. Each of the driving devices includes a reciprocating means or device, such as a cam or servomotor which separately operates the conveying means 120*a*, 120*b*. These driving devices may be programmed to control the relative reciprocation movement of each of the driving devices and thereby produce structures having any designated corrugation relationships. The parameters which may be varied to achieve the varying density are (a) the distance between the driving devices at time zero (at the moment the operation of the apparatus is actuated) or the relative positions of the outlets of the conveying means 120*a*, 120*b*, as well as (b) the horizontal moving speed of the conveying devices. The density across the thickness of the corrugated structure may be varied by adjusting these parameters. Thus, the length of the medium density portion can be controlled by adjusting the distance between the conveying means 120*a*, 120*b* or the driving devices 180*a*, 180*b*, respectively, which reciprocates the conveying means, at time zero. The length or size of the region of low density portions, typically adjacent a surface of the corrugated structure, can be controlled by adjusting the horizontal moving speed of the driving devices 180*a* and 180*b*. For example, to produce the corrugated structure illustrated in FIG. 17, the moving speeds of the driving devices 180*a* and 180*b* are adjusted to be substantially the same, that the proportions of the low density region are substantially the same. In comparison, the corrugated fiberfill structure shown in FIG. 18 may be obtained by adjusting the driving device 180*b* so that it moves faster than the driving device 180*a*. By such adjustments, a single low density region is provided.

FIG. 18 illustrates a corrugated structure which includes a small region of low density and a large region of high density material. To achieve this density variation, the driving device 180*a* moves the conveyor means 120*a* faster than the driving device 180*b* reciprocates the conveying device 120*b*. As a result, the conveying means 120*a* reaches one end of its range sooner than the driving device 180*b* causes the conveying means 120*b* to reach the end of its range. This results in a low density region formed from fibrous web A, 148, but without fibrous web B, 149, in that portion of the medium. Moving in the opposite direction, conveying means 120*a* reaches the opposite stop or end of the range at the same time as the conveying device 120*b* reaches the corresponding stop. This results in a high density portion which includes both fibrous webs 148 and 149. As a rule of thumb, the faster the driving device moves its associated conveying means, the longer is the portion of a particular density region. Thus, the size of the different density regions is also determined in part by the distance which the particular driving device causes the conveying means to move.

The number of different fibrous webs which may be combined to form the corrugated structure of the present invention is limited only by the number of webs which may be fed to the conveying passage or forming chamber 130. Thus, the corrugated fibrous structures depicted in FIGS. 19 to 21 include three fibrous webs which are formed to interlock or engage one another. Such corrugated structures may be prepared by apparatus such as those illustrated in FIGS. 30 and 31, differing from one another only in the inclusion of a brushing apparatus 90. In the apparatus illustrated in FIGS. 30 and 31, three fibrous webs, fibrous web A 148, fibrous web B 149 and fibrous web C, 151, are supplied by three separate conveying means 120*a*, 120*b* and 120*c*, respectively, to a forming chamber 130. The same considerations concerning programming of the movement of the reciprocating devices 180*a* and 180*b* in the embodiments illustrated in FIGS. 28 and 29 are also applicable to the driving or reciprocating means or devices which reciprocate the movement of conveying means 120*a*, 120*b* and 120*c*. Thus, for each driving means, the program for determining the density regions of the corrugated structure are generally set for the relative positions of the outlet ends of the conveying means 120*a*, 120*b* and 120*c* at time zero, the rates of reciprocating movement, and the length of movement of the outlet ends or feed supply ends of the conveying means.

Figure 22A:
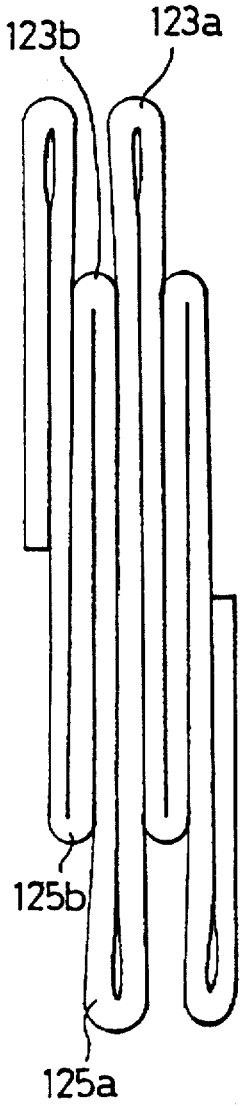
FIG. 22*a* is a side view of another embodiment of the corrugated fiberfill structure of the invention having projecting pleats, prior to completion of the varying density forming process.
Figure 22B:
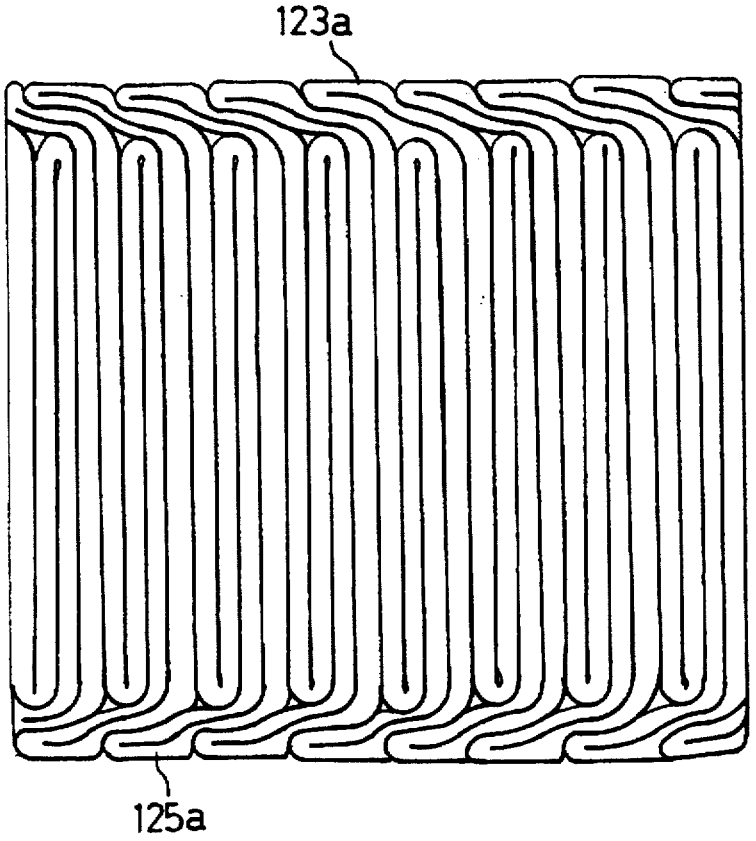
FIG. 22*b* is a side view of the embodiment of the corrugated fiberfill structure of the invention illustrated in FIG. 22*a*, after completion of the forming process.
Figure 23A:
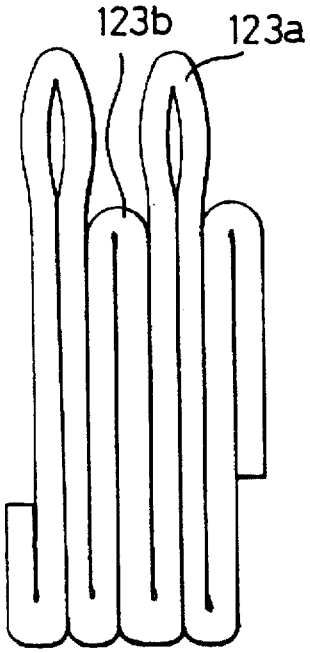
FIG. 23*a* is a side view of another embodiment of the corrugated fiberfill structure of the invention similar to FIG. 22*a* having projecting crests.
Figure 23B:
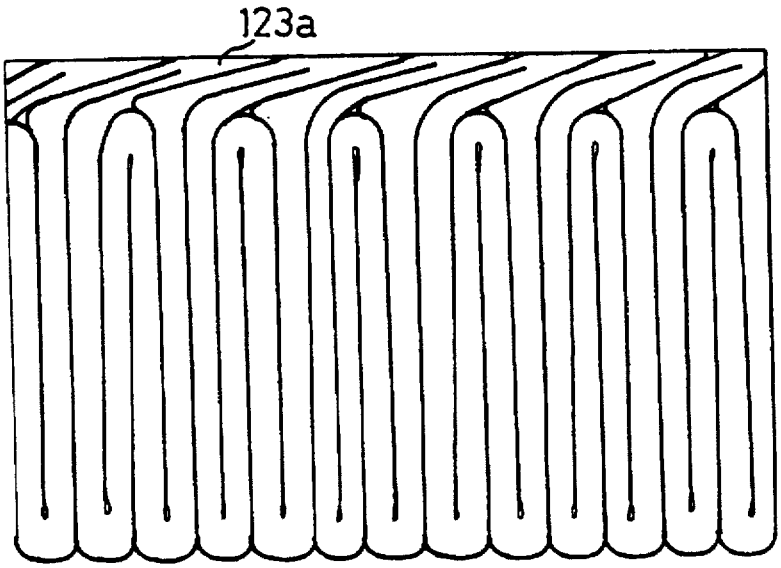
FIG. 23*b* is a side view of the completed embodiment of the corrugated fiberfill structure of the invention illustrating FIG. 23*a*, similar to FIG. 22*b*, having "shingles" on one surface.
Figure 24A:
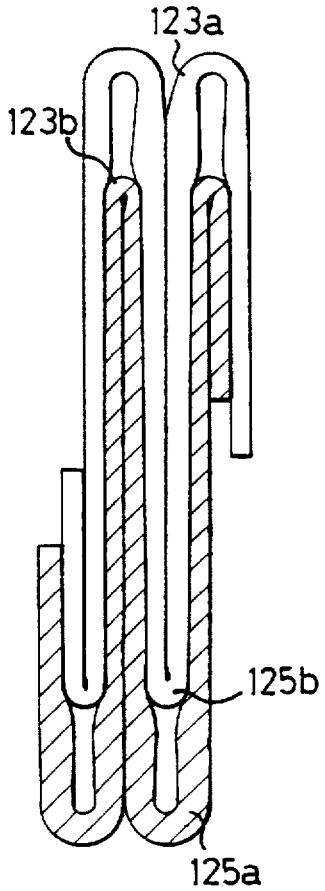
FIG. 24*a* is a side view of another embodiment of the corrugated fiberfill structure of the invention similar to that shown in FIG. 22*a* but formed from two engaging pleated webs.
Figure 24B:
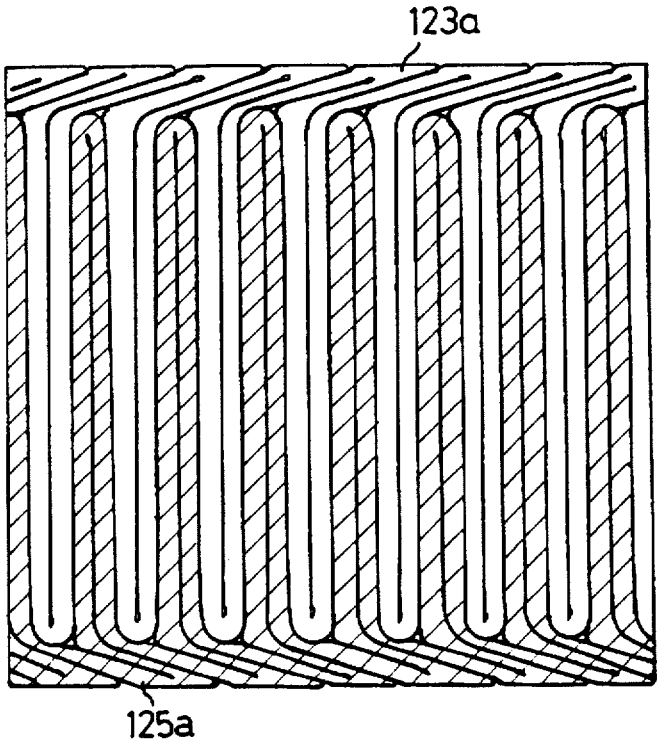
FIG. 24*b* is a side view of the completed embodiment of the corrugated fiberfill structure of the invention illustrated in FIG. 24*a;*
Figure 25A:
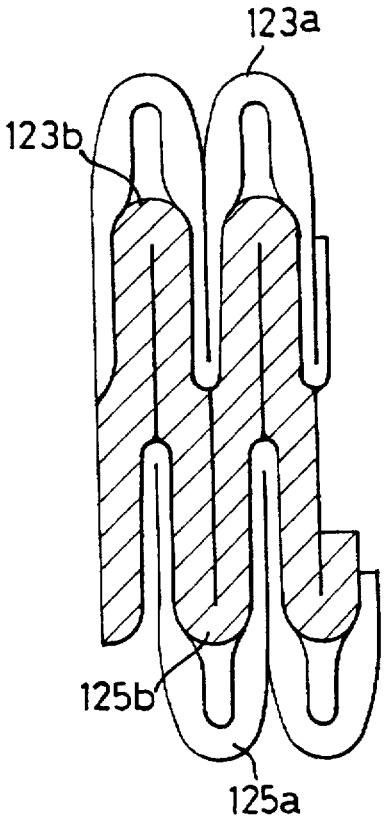
FIG. 25*a* is a side view of another embodiment of the corrugated fiberfill structure of the invention similar to that shown in FIG. 22*b* but formed from three engaging pleated webs.
Figure 25B:
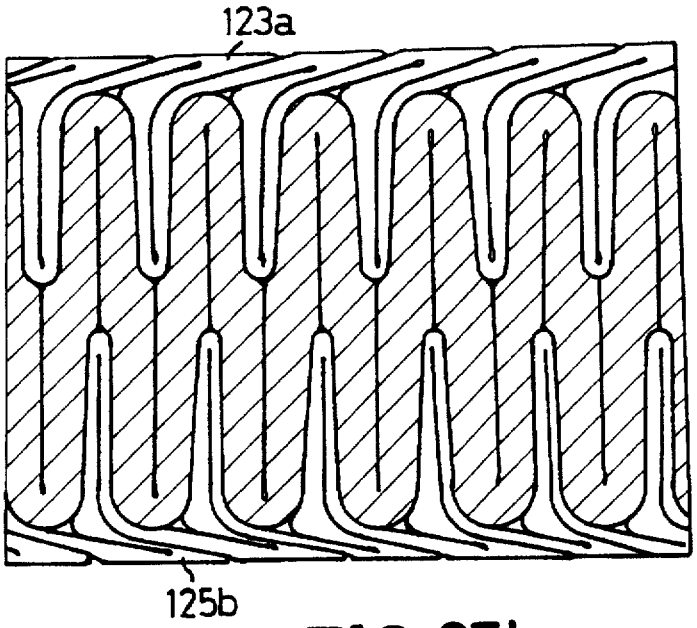
FIG. 25*b* is a side view of the completed embodiment of the corrugated fiberfill structure of the invention illustrated in FIG. 25*a;*
Figure 26:
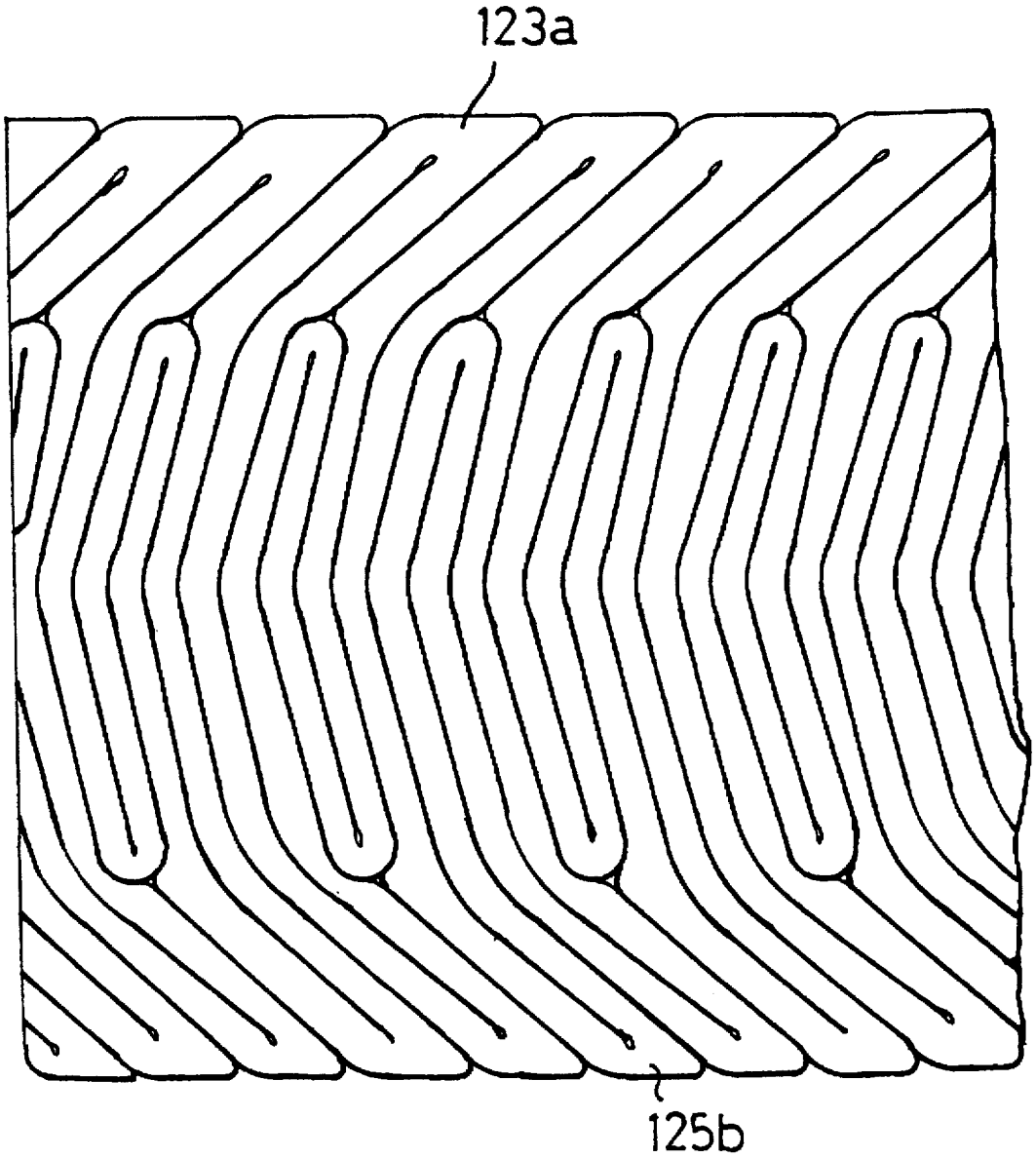
FIG. 26 is a side view of another embodiment of the corrugated fiberfill structure of the invention similar to FIG.

Another aspect of the present invention includes corrugated structures such as those illustrated in FIGS. 22*a*, 22*b*, 23*a*, 23*b*, 24*a*, 24*b*, 25*a*, 25*b* and 26. These embodiments share a common feature in that at least some of the crests of the pleats and/or bases of the pleats adjacent a surface of the corrugated fiberfill structure project above the crests and/or bases of neighboring pleats and are laid over or overlap a portion of the pleat adjacent the projecting crest or base of the pleat, with which the pleat is in contact. Thus, as illustrated in FIG. 22*b*, a crest portion 123*a* is laid over or overlaps another crest portion of a nearby pleat, in this instance a shorter adjacent pleat. Likewise, a base portion 125*a* is folded over and contacts another base portion of a nearby pleat. In each instance, the laid over crest and base portions give the appearance, when enlarged or viewed microscopically, of a "shingle" arrangement, i.e., a portion of one pleat overlapping a portion of a nearby pleat which in turn overlaps a portion of a nearby pleat, etc. While not absolutely necessary, it is preferred that the overlapping crest and/or base portions are those which are located on alternating pleats, separated by recessed pleats which do not participate in the laid-over arrangement and are sandwiched between two pleats which do participate in the laid over arrangement.

This aspect of the invention may be prepared with a substantially constant density across the corrugated structure, up to the regions at the surface(s) where projecting pleats are folded-over. Alternatively, like the structures described above, this aspect of the invention may also include structures in which the density varies across the structure, by varying the degree of overlapping and/or the number of different webs employed. Thus, in addition to having laid-over pleats, these structures may be provided with various combinations of low, medium and high density regions arranged between the folded-over surfaces of the corrugated medium.

The embodiments illustrated in FIGS. 22*a*, 22*b*, 23*a*, 23*b*, 24*a*, 24*b*, 25*a*, 25*b* and 26 provide a high degree of softness near the surfaces of the corrugated structure with a rigid high support interior region. The embodiments of this aspect of the invention also provide significantly improved evenness of the surface of the corrugated structure and improve mechanical strength. Although, similar improvements in surface smoothness and increases in strength in the machine direction occur when crests and peaks are subjected to brushing, the embodiment of this invention in which projecting pleats are folded over nearby pleats provides a much greater improvement of these properties.

In addition to the parameters discussed above, in order to achieve the laid-over or folded over crest and base portions of the pleats, or a "shingled" effect, the apparatus previously discussed is modified such that the width of the forming chamber 30 or 130 is arranged to be narrower than in the apparatus producing the non-overlapping crest and base portions. This is illustrated in the embodiments of the invention shown in FIGS. 32, 33 and 34, each of which is optionally provided with a brush apparatus.

To illustrate the increased strength which results from overlapping of the crests and/or bases of the pleats, several samples were prepared and tested as described below.

This example relates to the embodiment of vertical fold mat (batting) manufacture, as described immediately above, wherein some of the vertical folds are caused to extend beyond the upper and lower surfaces of the mat, and the mat is then forced into and through a channel or forming chamber to lay the extended vertical folds back onto the surfaces of the mat. The result is a mat having surfaces which appear, on overview or macroscopically, smoothly finished (as opposed to contoured) and, which exhibit increased machine direction (MD) modulus and tensile strength.

As a comparative test, corrugated mats (battings) were made by the (overlapping-folded back) process of this invention, and by the thermo-forming process described above that allowed the corrugated folds or pleats of the mats which have similar dimensions and are not folded over, to remain visible. These mats were constructed 1) using the same materials, 2) to the same weights and dimensions, and 3) to be comparable in quality.

Thus, in each instance a standard, or higher melting fiber, was blended with a lower melting thermal binder fiber. The latter consisted of a core of polyethylene terephthalate with a sheath of copolyethylene terephthalate/isophthalate having a melting temperature of 110° C. The low temperature melting binder fibers were about 50% by weight, of sheath material.

Samples #1 and #2 were made using 80% of 6.5 denier Type 808 DACRON® polyester intimately blended with 20% of the polymer thermal binder fiber, and a second set, corresponding to Samples #3 and #4, was made using 80% 15.0 denier Type 76 DACRON® polyester also intimately blended with 20% of the same polyester thermal binder fiber. The samples were approximately 2.0 inches thick. Samples of this invention were prepared using the device of FIG. 33 and the comparison samples were prepared using the device of FIG. 27.

Tests conducted on these samples included machine direction modulus and tensile strength and elongation to break.

Sample strips were cut one inch wide with a gage length of 8 inches in the machine direction. They were then pulled, on a tensile tester (Instron) having rubber-lined jaw faces, at a rate of 40 percent/minute. The results were transmitted to stress/strain curves.

Modulus at 10% elongation is determined by drawing a tangent to the stress/strain curve at 10% elongation.

$$\text{Modulus} = \frac{\text{Load at 10\% elongation}}{\text{Sample thickness} \times \text{sample width} \times 0.10\ \text{(elongation)}}$$

Tensile Strength is the load applied to a sample at the point where stress on the stress/strain curve is a maximum divided by the width of the sample at commencement of the test.

Elongation to Break (% Elongation) is the percentage elongation in a sample from start to break.

$$\%\ \text{Elongation} = 100 \times [(\text{length at break}) - (\text{length at start})]/(\text{length at start})$$

All of the tests were run five times for each sample. Results are tabulated below as an average of all runs:

TABLE

| Sample | Thickness (inches) | Density (lbs/ft$^3$) | Modulus (MPa) | Tensile Strength (N/cm) | % Elongation |
|---|---|---|---|---|---|
| #1 Folded-Over Pleat | 1.95 | 0.95 | 0.39 | 1.79 | 21.87 |
| #2 Uniform Pleat | 1.95 | 1.08 | 0.007 | 1.17 | 93.36 |
| #3 Folded-Over Pleat | 2.11 | 1.5 | 0.054 | 2.77 | 22.01 |
| #4 Uniform Pleat | 1.92 | 1.5 | 0.013 | 1.48 | 46.38 |

While the present invention has been explained in relation to its preferred embodiments and illustrated with various drawing figures, it is to be understood that the embodiments shown in the drawings are merely exemplary and that various modifications of the invention will be apparent to those skilled in the art upon reading this specification. Therefore, it is to be understood that the invention disclosed herein is intended to cover all such modifications as shall fall within the scope of the appended claims.

I claim:

1. A corrugated fiberfill structure comprising a single fibrous web folded to form a plurality of pleats having alternating crests and bases, each of the pleats having a pair of legs, each of the legs having a first leg surface and a second leg surface, the first leg surface of a first leg being in intimate contact with the first leg surface of an adjoining leg of the pleat and the second leg surface of the first leg being in intimate contact with the second leg surface of an adjoining leg of an adjacent pleat over a portion of each leg, at least some crests defining a first structural surface and at least some bases defining a second structural surface, a line transverse to and between the first and second structural surfaces defining a thickness direction of the structure, the pleats of the structure being arranged so that the structure has a density that varies in the thickness direction between the first and second structural surfaces wherein the legs of adjoining pleats are unequal in length.

2. The corrugated fiberfill structure according to claim 1 wherein the density is lowest adjacent the first structural surface.

3. The corrugated fiberfill structure according to claim 1 wherein the density is highest in a region of the structure remote from the first and second structural surfaces.

4. The corrugated fiberfill structure according to claim 1 wherein the density is highest intermediate the first and second structural surfaces and lowest adjacent at least one of the first and second structural surfaces.

5. The corrugated fiberfill structure according to claim 1 wherein the first and second structural surfaces are parallel.

6. The corrugated fiberfill structure according to claim 1 wherein the pleats have an arcuate configuration.

7. The corrugated fiberfill structure according to claim 2 wherein crest portions and base portions of at least some of the pleats are folded and at least partially overlap and contact corresponding crests and base portions, respectively, of adjacent pleats.

8. The corrugated fiberfill structure according to claim 4 wherein crest portions and base portions of at least some of the pleats are folded and at least partially overlap and contact corresponding crests and base portions, respectively, of adjacent pleats.

9. A corrugated fiberfill structure comprising two fibrous webs folded to form a plurality of pleats having alternating crests and bases, each of the pleats having a pair of legs, each of the legs having a first leg surface and a second leg surface, the first leg surface of a first leg being in intimate contact with the first leg surface of an adjoining leg of the pleat and the second leg surface of the first leg being in intimate contact with the second leg surface of an adjoining leg of an adjacent pleat over a portion of each leg, at least some crests defining a first structural surface and at least some bases defining a second structural surface, a line transverse to and between the first and second structural surfaces defining a thickness direction of the structure, the pleats of the structure being arranged so that the structure has a density that varies in the thickness direction between the first and second structural surfaces wherein the legs of adjoining pleats are unequal in length.

10. The corrugated fiberfill structure according to claim 9 wherein the pleats of the two fibrous webs are interleaved.

11. The corrugated fiberfill structure according to claim 9 wherein crest portions and base portions of at least some of the pleats are folded and at least partially overlap and contact corresponding crests and base portions, respectively, of adjacent pleats.

12. The corrugated fiberfill structure according to claim 10 wherein crest portions and base portions of at least some of the pleats are folded and at least partially overlap and contact corresponding crests and base portions, respectively, of adjacent pleats.

13. A corrugated fiberfill structure comprising three fibrous webs folded to form a plurality of pleats having alternating crests and bases, each of the pleats having a pair of legs, each of the legs having a first leg surface and a second leg surface, the first leg surface of a first leg being in intimate contact with the first leg surface of an adjoining leg of the pleat and the second leg surface of the first leg being in intimate contact with the second leg surface of an adjoining leg of an adjacent pleat over a portion of each leg, at least some crests defining a first structural surface and at least some bases defining a second structural surface, a line transverse to and between the first and second structural surfaces defining a thickness direction of the structure, the pleats of the structure being arranged so that the structure has a density that varies in the thickness direction between the first and second structural surfaces wherein the legs of adjoining pleats are unequal in length.

14. The corrugated fiberfill structure according to claim 13 wherein the pleats of a first of the three fibrous webs are interleaved with and engage the pleats of second and third fibrous webs of the three fibrous webs.

15. The corrugated fiberfill structure according to claim 13 wherein crest portions and base portions of at least some of the pleats are folded and at least partially overlap and contact corresponding crests and base portions, respectively, of adjacent pleats.

16. The corrugated fiberfill structure according to claim 14 wherein crest portions and base portions of at least some of the pleats are folded and at least partially overlap and contact corresponding crests and base portions, respectively, of adjacent pleats.

17. A corrugated fiberfill structure comprising at least one fibrous web folded to form a plurality of pleats having alternating crests and bases, each of the pleats having a pair of legs, each of the legs having a first leg surface and a second leg surface, the first leg surface of a first leg being in intimate contact with the first leg surface of an adjoining leg of the pleat and the second leg surface of the first leg being in intimate contact with the second leg surface of an adjoining leg of an adjacent pleat over a portion of each leg, at least some crests defining a first structural surface and at least some bases defining a second structural surface, a line transverse to and between the first and second structural surfaces defining a thickness direction of the structure, the pleats of the structure being arranged so that the structure has a density that varies in the thickness direction between the first and second structural surfaces wherein crest portions and base portions of at least some of the pleats are folded and at least partially overlap and contact corresponding crests and base portions, respectively, of adjacent pleats.

18. A method for forming a corrugated bonded fiberfill structure having pleats, a first surface defined by crests of at least some of the pleats, and a second surface defined by bases of at least of some of the pleats, the method comprising:

lapping at least one fibrous web formed from first fibers and second fibers in alternating directions to form alternating pleats, adjoining pleats having unequal lengths, to form a corrugated fibrous web varying in density between the first and second surfaces; and bonding the pleats of the corrugated fibrous web.

19. The method according to claim 18, wherein the second fibers have a lower melting point than the first fibers, including bonding the pleats by heating the corrugated fibrous web to melt the second fibers and bond the corrugations and the first fibers together.

20. The method according to claim 18 including impregnating the corrugated fibrous web with a resin and bonding the pleats by heating the corrugated fibrous web.

21. The method according to claim 18 including, prior to bonding the pleats, brushing the crests and bases of the corrugated fibrous web so that fibers from each of the crests and each of the bases extend to adjacent crests and bases, respectively, bridging gaps between the crests and bases.

22. A corrugated fiberfill structure comprising at least one fibrous web folded to form a plurality of pleats having alternating crests and bases, each of the pleats having a pair of legs, each of the legs having a first leg surface and a second leg surface, the first leg surface of a first leg being in intimate contact with the first leg surface of an adjoining leg of the pleat and the second leg surface of the first leg being in intimate contact with the second leg surface of an adjoining leg of an adjacent pleat over a portion of each leg, at least some crests defining a first structural surface and at least some bases defining a second structural surface, a line transverse to and between the first and second structural surfaces defining a thickness direction of the structure, the pleats of the structure being arranged so that the structure has a density that varies in the thickness direction between the first and second structural surfaces wherein fibers from at least some of the crests and at least some of the bases extend to adjoining crests and bases, respectively, bridging gaps between adjacent crests and adjacent bases, thereby defining the first and second surfaces.

* * * * *